US009177705B2

(12) United States Patent
Hidaka et al.

(10) Patent No.: US 9,177,705 B2
(45) Date of Patent: Nov. 3, 2015

(54) SINTERED RARE EARTH MAGNET, METHOD OF PRODUCING THE SAME, AND ROTATING MACHINE

(75) Inventors: Tetsuya Hidaka, Tokyo (JP); Kazuo Sato, Tokyo (JP); Kazuya Sakamoto, Tokyo (JP); Shinya Fujito, Tokyou (JP); Motoaki Hosako, Tokyo (JP); Motohisa Murata, Tokyo (JP); Koji Mitake, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/119,354

(22) PCT Filed: May 25, 2012

(86) PCT No.: PCT/JP2012/064254

§ 371 (c)(1),
(2), (4) Date: Feb. 28, 2014

(87) PCT Pub. No.: WO2012/161355

PCT Pub. Date: Nov. 29, 2012

(65) Prior Publication Data

US 2014/0184370 A1 Jul. 3, 2014

(30) Foreign Application Priority Data

May 25, 2011 (JP) ..... 2011-117447

(51) Int. Cl.
*H01F 1/08* (2006.01)
*H01F 41/02* (2006.01)
(Continued)

(52) U.S. Cl.
CPC ..... *H01F 1/086* (2013.01); *C22C 33/02* (2013.01); *C22C 38/002* (2013.01);
(Continued)

(58) Field of Classification Search
CPC ..... B22F 2207/01; C22C 2202/02; C22C 38/005; H01F 1/0577; H01F 1/053
USPC ..... 148/105
See application file for complete search history.

(56) References Cited

U.S. PATENT DOCUMENTS 6,187,259 B1 * 2/2001 Yamashita et al. ..... 419/12
7,090,730 B2 * 8/2006 Nomura et al. ..... 148/302
(Continued)

FOREIGN PATENT DOCUMENTS

CN 101685695 A 3/2010
EP 2 178 096 A1 4/2010
(Continued)

OTHER PUBLICATIONS

Sep. 4, 2012 International Search Report issued in International Application No. PCT/JP2012/064254 with English-language Translation.

*Primary Examiner* — Jie Yang
*Assistant Examiner* — Xiaowei Su
(74) *Attorney, Agent, or Firm* — Oliff PLC

(57) ABSTRACT

A sintered rare earth magnet rotating machine and method improve temperature properties and strength having an excellent corrosion resistance. The sintered rare earth magnet includes at least a main phase composed of $R_2T_{14}B$ (R represents at least one rare earth element of Nd, Pr or both and T represents at least one transition metal element including Fe or Fe and Co) compound and a grain boundary phase containing a higher proportion of R than the main phase, wherein the main phase includes a heavy rare earth element (one of Dy, Tb or both), at least part of main phase grains of the main phase included in the sintered rare earth magnet includes at least the following regions, low, high and intermediate concentration regions. These regions exist in order of low, high, and intermediate concentration regions, from low concentration region towards the grain boundary phase in the main phase grains.

8 Claims, 12 Drawing Sheets
(3 of 12 Drawing Sheet(s) Filed in Color)

(51) Int. Cl.

| | |
|---|---|
| ***C22C 33/02*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |
| ***H01F 1/057*** | (2006.01) |

(52) U.S. Cl.

CPC ..... *C22C 38/005* (2013.01); *C22C 38/06* (2013.01); *C22C 38/10* (2013.01); *C22C 38/14* (2013.01); *C22C 38/16* (2013.01); *H01F 1/0577* (2013.01); *H01F 41/0266* (2013.01); *B22F 2998/10* (2013.01); *C22C 2202/02* (2013.01)

(56) References Cited

U.S. PATENT DOCUMENTS

| | | | | |
|---|---|---|---|---|
| 8,123,832 | B2 | 2/2012 | Kato et al. | |
| 8,287,661 | B2 | 10/2012 | Ishii et al. | |
| 2009/0019969 | A1 | 1/2009 | Kato et al. | |
| 2010/0040501 | A1 * | 2/2010 | Kato et al. | 419/38 |
| 2011/0012699 | A1 | 1/2011 | Odaka et al. | |
| 2011/0262297 | A1 | 10/2011 | Ishii et al. | |

FOREIGN PATENT DOCUMENTS

| | | |
|---|---|---|
| JP | A-07-122413 | 5/1995 |
| JP | A-10-140211 | 5/1998 |
| JP | A-2001-217112 | 8/2001 |
| JP | A-2001-230107 | 8/2001 |
| JP | A-2006-210450 | 8/2006 |
| JP | A-2007-266199 | 10/2007 |
| JP | A-2007-294917 | 11/2007 |
| WO | WO 2006/098204 A1 | 9/2006 |
| WO | WO 2010/082492 A1 | 7/2010 |

* cited by examiner

SINTERED RARE EARTH MAGNET, METHOD OF PRODUCING THE SAME, AND ROTATING MACHINE

TECHNICAL FIELD

The present invention relates to a sintered rare earth magnet which is used for a magnetic field source such as a rotating machine like a motor and a magnetic resonance imaging system (MRI), a method of producing the same and a rotating machine

RELATED ART

Known as a sintered rare earth magnet is one having a R-T-B (R represents one or more of rare earth element including either one of Nd, Pr or both as main components, T represents one or more of transition metal element including Fe or Fe and Co, and B represents B or B and C) based composition (R-T-B based sintered rare earth magnet). The R-T-B based sintered rare earth magnet has a composition comprising a main phase composed of $R_2T_{14}B$ compound and a grain boundary phase including an R-rich phase that contains a higher proportion of R than the main phase. The R-T-B based sintered rare earth magnet offers excellent magnetic properties having a high coercivity HcJ. Therefore, the R-T-B based sintered rare earth magnets are widely used, as high performance permanent magnets, for a motor, generator and the like which requires a high performance. For instance, they are used in a magnetic field source such as electric vehicles, hybrid cars, voice coil motor (VCM) of hard disc drive (HDD), and MRI. Particularly, they are used for the purpose that high magnetic properties are required.

The R-T-B based sintered rare earth magnet has high activity since R is included in the composition. For instance, it is easily oxidized by oxygen in the atmosphere. Therefore, the magnetic properties easily deteriorate by oxidation since corrosion resistance as an element body is not high. Further, when using the R-T-B based sintered rare earth magnets in various devices such as a motor, temperature properties capable of maintaining favorable coercivity HcJ are required in order to meet a condition in a high temperature environment.

Further, when implementing a surface treatment on the R-T-B based sintered rare earth magnet, chamfering is generally performed by barrel and the like as a preprocessing. Therefore, if the strength of the R-T-B based sintered rare earth magnet is low, the yield rate gets worse since breaking and cracking including chipping are generated by a processing. Furthermore, as products using the R-T-B based sintered rare earth magnet are diversified, thinner and smaller products are desired. However, these thinner and smaller products are relatively prone to breaking and cracking. Therefore, in order to improve the yield rate when producing products like the above, the R-T-B based sintered rare earth magnet having a higher mechanical strength is required.

Therefore, in order to improve the temperature properties and the strength of the R-T-B based sintered rare earth magnet and also to improve corrosion resistance of the R-T-B based sintered rare earth magnet, various studies for improvement of the R-T-B based sintered rare earth magnet have been conducted.

In order to improve characteristics of the R-T-B based sintered rare earth magnet, conventionally, for instance, the R-T-B based sintered rare earth magnet including a plurality of regions where Dy as a heavy rare earth element is highly concentrated in a main phase composed of $R_2T_{14}B$ compound (for instance, refer to Patent Literature 1) has been suggested to obtain a high coercivity HcJ and to suppress a reduction of residual magnetic flux density Br.

PRIOR ART

Patent Literature

Patent Literature 1: Japanese Published Unexamined Application No: H07-122413

SUMMARY OF THE INVENTION

Problem to be Solved by the Invention

However, the region where Dy is highly concentrated simply exists in a main phase grain is not enough sufficiently stably to improve the magnetic properties of the sintered rare earth magnet.

Particularly, in recent years, the R-T-B based sintered rare earth magnet tends to be widely used in motorcars, industrial machineries and the like, and the use of the R-T-B based sintered rare earth magnet in a high temperature environment is increased compared to before. In line with this, there is a need for improving the temperature properties of the R-T-B based sintered rare earth magnet in order to maintain the coercivity high in a high temperature environment. Furthermore, there is a need for improving the strength of the R-T-B based sintered rare earth magnet and also improving the corrosion resistance.

The present invention has been made by considering the above circumstances, and an object of the present invention is to provide a sintered rare earth magnet capable of improving the temperature properties and the strength and also having an excellent corrosion resistance, a method of producing the same, and a rotating machine

Solution to Problem

In order to solve the above-mentioned problems and to achieve objects, the inventors of the present invention earnestly studied about the sintered rare earth magnet. As a result, they focused that at least three regions where the concentration of heavy rare earth elements differs are formed on a part of the main phase grain included in sintered rare earth magnet in accordance with the concentration of heavy rare earth elements (including at least either one of Dy, Tb or both). For the three regions, they are low concentration region, high concentration region, and intermediate concentration region. These three regions are included so as to form three-layered structure in order of low concentration region, high concentration region and intermediate concentration region, from the low concentration region toward a grain boundary phase in the main phase. With this, they found that it enables to maintain the coercivity HcJ high even in a high temperature environment and also enables to improve the temperature properties of the R-T-B based sintered rare earth magnet. Further, they also found that it enables to improve the strength of the R-T-B based sintered rare earth magnet, and also enables to have an excellent corrosion resistance. The present invention has been made based on their above findings.

In order to achieve this object, a sintered rare earth magnet according to the present invention comprises at least a main phase composed of $R_2T_{14}B$ (R represents one or more of rare earth element including either one of Nd, Pr or both as main component, and T represents one or more of transition metal element including Fe or Fe and Co) compound and a grain boundary phase containing a higher proportion of R than said main phase, wherein said main phase includes a heavy rare earth element (includes at least either one of Dy, Tb or both), at least a part of main phase grain of said main phase included in said sintered rare earth magnet includes at least three regions where the concentration of said heavy rare earth elements differs, the three regions where the concentration of said heavy rare earth elements differs are low concentration region where the concentration of said heavy rare earth elements is the lowest in three regions, high concentration region where the concentration of said heavy rare earth elements is the highest in three regions, and intermediate concentration region where the concentration of said heavy rare earth elements is higher than said low concentration region and is lower than said high concentration region, and said three regions exist in order of said low concentration region, said high concentration region, and said intermediate concentration region, from said low concentration region toward said grain boundary phase in said main phase grain.

By including at least three regions in accordance with the concentration of heavy rare earth elements in the main phase grain, the movement of magnetic domain wall of reverse magnetic domain is suppressed by the concentration differences of heavy rare earth elements. With this, it enables to maintain the coercivity HcJ high even in a high temperature environment, compared with the case that the main phase is formed only by high concentration region which spreads evenly across the main phase and the case that the main phase is formed so that a region where the rare earth concentration is higher than the low concentration region is faulted outside the low concentration region. Specifically, it is considered that it enables to improve the temperature properties of the obtained sintered rare earth magnet.

Further, generally, the heavy rare earth elements tend to get easily oxidized compared with light rare earth elements such as Nd. However, in the present invention, a part of the main phase grain includes three regions in accordance with the concentration of heavy rare earth elements, and the intermediate concentration region is formed near the grain boundary phase. Therefore, compared with the case that the main phase is entirely formed only by the high concentration region and the case that the main phase includes the high concentration region formed outside the low concentration region, it is considered that it enables to improve the corrosion resistance of the sintered rare earth magnet.

Further, an $R_2T_{14}B$ based sintered rare earth magnet is easily fractured between the main phase and the grain boundary phase. Therefore, an interface state between the main phase and the grain boundary phase has effects on the overall strength of the sintered rare earth magnet. In the present invention, a part of the main phase grain includes at least three regions in accordance with the concentration of heavy rare earth elements. Further, the main phase includes the three regions in order of low concentration region, high concentration region, and intermediate concentration region, from the low concentration region toward the grain boundary phase. Specifically, it is considered that it enables to improve the interface state between the main phase and the grain boundary phase and also enables to enhance the strength of the sintered rare earth magnet.

Therefore, for the sintered rare earth magnet according to the present invention, at least a part of the main phase grain of the main phase included in the sintered rare earth magnet includes three regions where the concentration of heavy rare earth elements differs, and the three regions are low concentration region, high concentration region and intermediate concentration region. These three regions exist in order of low concentration region, high concentration region and intermediate concentration region, from the low concentration region of the main phase toward the grain boundary phase. With this, it enables to improve the temperature properties and the strength and also enables to have an excellent corrosion resistance.

Further, for the sintered rare earth magnet according to the present invention, at least a part of the main phase grain of the main phase includes at least three regions. Therefore, compared with magnets provided with the main phase which is entirely formed only by the high concentration region or the main phase that includes the high concentration region formed outside the low concentration region, with the sintered rare earth magnet according to the present invention, it enables to produce a sintered rare earth magnet having an equivalent coercivity HcJ by using a small amount of heavy rare earth elements. With this, it enables to reduce costs required for producing the sintered rare earth magnet.

Further, in the present invention, it is preferable that the main phase grains wherein said high concentration region is adjacent to at least a part of said low concentration region and said intermediate concentration region is adjacent to at least a part of said high concentration region exist at 5% or more in said sintered rare earth magnet. By including a predetermined amount of the main phase grains, it enables stably to obtain characteristics of the obtained sintered rare earth magnet.

Further, in the present invention, it is preferable that said main phase grains exist at 30% or more in said sintered rare earth magnet. With this, the main phase grain having three regions wherein the high concentration region is adjacent to at least a part of the low concentration region and the intermediate concentration region is adjacent to at least a part of the high concentration region are increased. Therefore, it enables more stably to improve the characteristics of the obtained sintered rare earth magnet.

Furthermore, in the present invention, it is preferable that the main phase grains wherein said high concentration region is adjacent to the overall periphery of said low concentration region and said intermediate concentration region is adjacent to the overall periphery of said high concentration region exist at 3% or more in said sintered rare earth magnet With this, three regions are included in the main phase grain in a state that they are formed circumferentially in order of low concentration region, high concentration region, and intermediate concentration region, from the low concentration region toward the grain boundary phase. By including a predetermined amount of the main phase grains in the sintered rare earth magnet, it enables more stably to improve the characteristic of the obtained sintered rare earth magnet.

Further, in the present invention, it is preferable that said main phase grains exist at 5% or more in said sintered rare earth magnet. The main phase grain wherein three regions exist in a three-layered structure in order of low concentration region, high concentration region, and intermediate region is further increased. Therefore it enables more stably to improve the characteristics of the obtained sintered rare earth magnet.

Further, in the present invention, the average concentration value of said heavy rare earth element in said intermediate concentration region shall be determined as the average concentration value of said heavy rare earth element from the maximum concentration of said heavy rare earth element to said grain boundary phase. With this, the average concentration value of the heavy rare earth element in the intermediate concentration region which is formed from the high concentration region to the grain boundary phase becomes clear.

Furthermore, in the present invention, when the minimum concentration of said heavy rare earth element in said main phase is expressed by a, the maximum concentration of said heavy rare earth element in said main phase is expressed by β, and the average concentration value of said heavy rare earth element in said intermediate concentration region is expressed by γ, the average concentration value of said heavy rare earth element in said intermediate concentration region is expressed by the following formula (A) and it is preferable that the value of the following formula (A) is in the range of 0.2 or more to 0.8 or less. By setting the average concentration of the heavy rare earth element in the intermediate concentration region which is formed from the maximum concentration to the grain boundary phase within the predetermined range, the three-layered structure formed by low concentration region, high concentration region, and intermediate concentration region becomes clearer. With this, it enables to improve the temperature properties and the strength of the obtained sintered rare earth magnet and also enables more stably to obtain excellent corrosion resistance.

$$(\gamma-\alpha)/(\beta-\alpha) \qquad \text{formula (A)}$$

Further, in the present invention, it is preferable that the value of said formula (A) is in the range of 0.3 or more to 0.75 or less. By determining the average concentration of the heavy rare earth element in the intermediate concentration region formed from the high concentration region to the grain boundary phase within a predetermined range, the three-layered structure of low concentration region, high concentration region, and intermediate concentration region becomes clearer, and it enables more stably to obtain the characteristics of the obtained sintered rare earth magnet.

Further, in the present invention, it is preferable that the value of said formula (A) is in the range of 0.35 or more to 0.7 or less. With this, the three-layered structure of low concentration region, high concentration region and intermediate region in the main phase becomes clearer, and it enables more stably to obtain the characteristics of the obtained sintered rare earth magnet.

Furthermore, in the present invention, it is preferable that the main alloy including $R_2T_{14}B$ compound and the sub alloy including at least HR (HR represents one or more of rare earth element including at least either one of Dy, Tb or both) and T are used as raw material alloys. With this, it enables stably to produce the sintered rare earth magnet.

Further, in the present invention, it is preferable that a relative density of said sintered rare earth magnet is 99% or more. With this, it enables stably to form the sintered rare earth magnet that contains a lot of main phase grains including at least three regions, so that the three-layered structure is formed in order of low concentration region, high concentration region, and intermediate concentration region in accordance with the concentration of heavy rare earth elements, from the low concentration region in the main phase grain toward the grain boundary phase.

Further, in order to achieve this object, the method of producing a sintered rare earth magnet according to the present invention, for producing the sintered rare earth magnet that includes at least a main phase composed of $R_2T_{14}B$ (R represents one or more of rare earth element including either one of Nd, Pr or both as main component, and T represents one or more of transition metal element including Fe or Fe and Co) compound, and a grain boundary phase containing a higher proportion of R than said main phase, comprises a mixture production step in which alloy powders of main alloy including $R_2T_{14}B$ compound and alloy powders of sub alloy including at least HR (HR represents one or more of rare earth element including at least either one of Dy, Tb or both) and T are mixed to obtain a mixture, a pressing step in which said mixture is pressed to obtain a green compact, a heating up step in which said green compact is heated up under the condition that the average heating rate from 600° C. to the sintering temperature is determined as 2° C./min or more to 10° C./min or less, a sintering step in which said green compact is sintered to obtain a sintered body, and a cooling step in which said sintered body is cooled under the condition that the average cooling rate from the sintering temperature to 600° C. is determined as 3° C./min or more to less than 20° C./min, wherein said main phase includes the heavy rare earth element (including at least either one of Dy, Tb or both), at least a part of main phase grain of said main phase included in said sintered rare earth magnet includes at least three regions where the concentration of heavy rare earth elements differs, the three regions where the concentration of said heavy rare earth elements differs are a low concentration region where the concentration of said heavy rare earth elements is the lowest in three regions, a high concentration region where the concentration of said heavy rare earth elements is the highest in three regions, and an intermediate concentration region where the concentration of said heavy rare earth elements is higher than said low concentration region and lower than said high concentration region, and said three regions exist in order of said low concentration region, said high concentration region and said intermediate concentration region, from said low concentration region in said main phase grain toward said grain boundary phase.

While sintering the green compact, it enables to form at least three regions where the concentration of the heavy rare earth elements differs in main phase of the sintered rare earth magnet, since a concentration difference of the heavy rare earth elements in main phase is easily caused, by determining either one of the average heating rate and the average cooling rate or both within the above range. The three regions are low concentration region, high concentration region, and intermediate concentration region. These three regions can be included in order of low concentration region, high concentration region, and intermediate concentration region, in accordance with the concentration of the heavy rare earth elements, from the low concentration region toward the grain boundary phase. With this, compared with the case that the main phase is entirely formed only by the high concentration region, it enables to have an equivalent coercivity HcJ and also enables to improve a residual magnetic flux density Br, with smaller amount of heavy rare earth elements. Therefore, it is considered that it enables to produce the sintered rare earth magnet having effectively improved magnetic properties with smaller amount of heavy rare earth elements.

Further, by forming at least three regions in main phase grains in accordance with the concentration of the heavy rare earth elements, the movement of magnetic domain wall in a reverse magnetic domain can be suppressed due to the concentration difference of the heavy rare earth elements. With this, compared with the case that the main phase is formed only by the high concentration region which spreads evenly across the main phase or the case that the main phase is formed so that a region where the rare earth concentration is higher than the low concentration region is formed outside the low concentration region, it enables to maintain the coercivity HcJ high even in a high temperature environment. Therefore, it is considered that the temperature properties of the obtained sintered rare earth magnet can be further improved.

Further, the intermediate concentration region is formed in a region near the grain boundary phase of the main phase grains. Therefore, compared with the case that the main phase is entirely formed only by the high concentration region or the case that the main phase is formed so that the high concentration region is formed outside of the low concentration region, it is considered that it enables to improve the corrosion resistance since the concentration of the heavy rare earth elements is relatively low.

Further, in accordance with the concentration of the heavy rare earth elements, the main phase includes a three-layered structure in order of low concentration region, high concentration region, and intermediate concentration region, from the low concentration region toward the grain boundary phase. With this, it is considered that the interface state between the main phase and the grain boundary phase is improved and the strength of the sintered rare earth magnet is increased.

Further, for the heavy rare earth element, compared with the main phase entirely formed only by the high concentration region or the main phase which is formed so that the high concentration region is formed outside of the low concentration region, it enables to produce the sintered rare earth magnet having an equivalent coercivity HcJ with a small amount of heavy rare earth elements and also enables to reduce a cost required for producing the sintered rare earth magnet.

In view of the above, according to the present invention, at least a part of the main phase grain of the main phase included in the sintered rare earth magnet includes the three-layered structure in order of low concentration region, high concentration region, and intermediate concentration region, from the low concentration region toward the grain boundary phase, in accordance with the concentration of the heavy rare earth elements. With this, it enables effectively to distribute the heavy rare earth elements in the main phase, and also enables to obtain the sintered rare earth magnet having the improved temperature properties and the strength and also having the excellent corrosion resistance.

Further, in order to achieve the above object, a rotating machine according to the present invention includes any of the above sintered rare earth magnet. By applying the sintered rare earth magnet according to the present invention to the permanent magnet which is used in the magnetic field source such as a rotating machine like the motor and MRI, it enables to have a high coercivity HcJ even in a high temperature environment. Further, it enables to have a high strength even if the permanent magnet is made thinner and smaller. With this, it enables to further improve the performances of rotating machines, magnetic field sources and the like.

Effect of the Invention

According to the present invention, it enables to obtain a sintered rare earth magnet capable of improving temperature properties and strength and also having an excellent corrosion resistance.

BRIEF EXPLANATION OF THE DRAWINGS

The patent or application file contains at least one drawing executed in color. Copies of this patent or patent application publication with color drawing(s) will be provided by the Office upon request and payment of the necessary fee.

MODES FOR CARRYING OUT THE INVENTION

Figure 1:
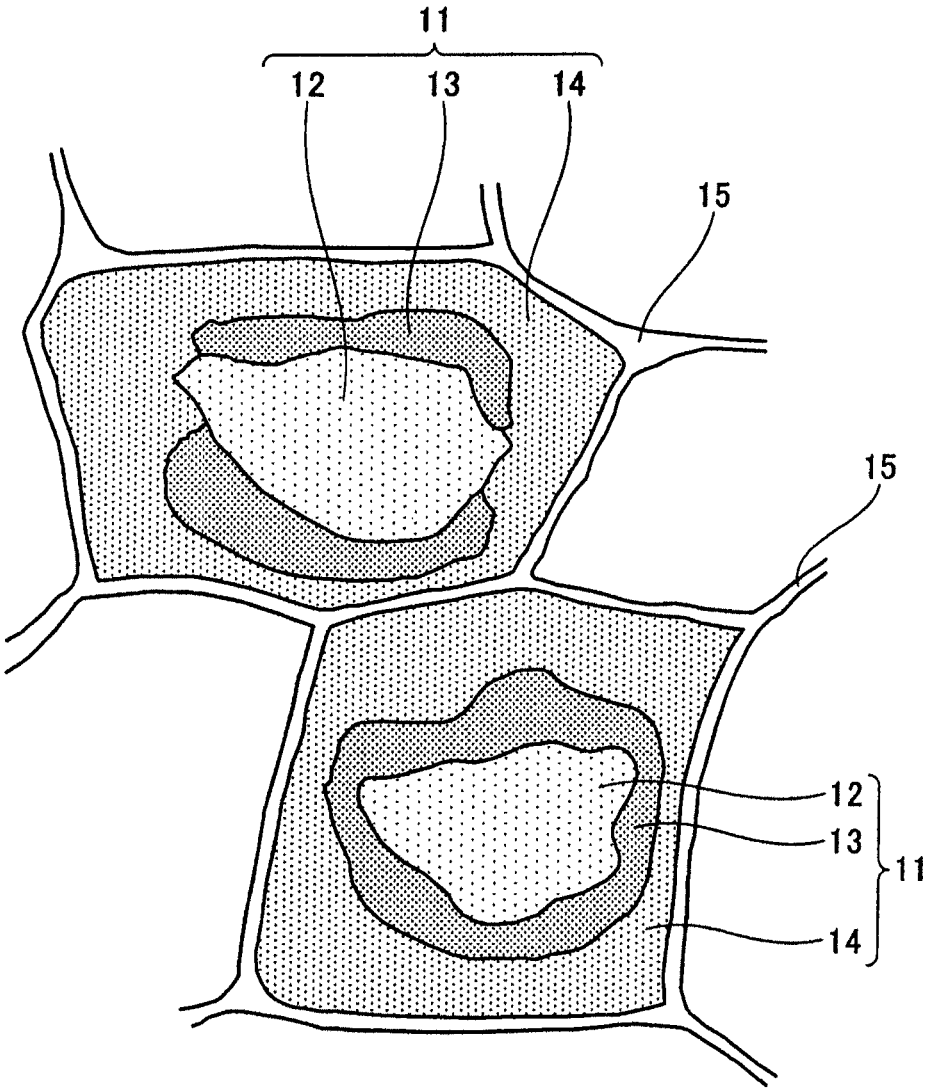
FIG. 1 is a schematic diagram briefly showing the composition of main phase included in a rare earth sintered magnet.

The followings are the detailed explanations of the present invention by reference to Figures. Please note that the present invention is not limited to the following modes for carrying out the invention (hereinafter referred to as "embodiment"). Further, the constituent elements in the following embodiment include what a person ordinary skilled in the art can easily conceive of and substantially the same one, specifically, include the same within the equivalent range. Further, it is possible appropriately to combine the constituent elements disclosed in the following embodiment.

<Sintered Rare Earth Magnet>

The followings are the explanation of embodiments of sintered rare earth magnet according to the present invention. The sintered rare earth magnet according to the present embodiment includes at least a main phase composed of $R_2T_{14}B$ (R represents one or more of rare earth element including either one of Nd, Pr or both as main component, and T represents one or more of transition metal element including Fe or Fe and Co) compound and a grain boundary phase containing a higher proportion of R than said main phase. This sintered rare earth magnet is a sintered body produced by using R-T-B based alloys. Further, the sintered rare earth magnet means not only the magnetic products that are processed and magnetized, but also magnetic products that are not magnetized.

The main phase has a crystal structure composed of $R_2T_{14}B$-type tetragonal. The particle size of the main phase is generally in the range of 1 μm to 30 μm.

The grain boundary phase includes an R-rich phase that contains a higher proportion of R than the main phase. For the grain boundary phase, a boron-rich phase containing a higher proportion of boron (B) than the main phase may be included in addition to the R-rich phase.

R represents one or more of rare earth element including either one of Nd, Pr or both as main component. The rare earth element refers to Sc, Y, and lanthanoid that belong to group 3 in a long period type periodic table. As for the lanthanoid, for instance, La, Ce, Pr, Nd, Sm, Eu, Gd, Tb, Dy, Ho, Er, Tm, Yb, Lu and the like are included. The rare earth element is classified into light rare earth element and heavy rare earth element. The heavy rare earth element HR refers to Gd, Tb, Dy, Ho, Er, Tm, Yb, and Lu. The light rare earth element refers to rare earth elements other than the above. From the aspect of production cost and magnetic properties, it is preferable that R includes either one of Nd, Pr or both as main component.

T represents one or more of transition metal element including Fe or Fe and Co. T may be Fe alone, and a part of Fe may be substituted with Co. From the aspect of improvement of the coercivity HcJ and also reduction of the production cost, in addition to Fe and Co, T may further include at least one kind of element, for instance, such as Al, Ga, Si, Ti, Bi, Sb, Ge, Sn, Zn, V, Cr, Mn, Ni, Cu, Zr, Nb, Mo, Hf, Ta, and W.

Further, B may be B alone, and a part of B may be substituted with C. Since C has corrosion resistance, it enables to improve the corrosion resistance by substituting a part of B with C.

The content of R in the sintered rare earth magnet according to the present embodiment is preferably in the range of 25 mass % or more to less than 35 mass %, more preferably, in the range of 28 mass % or more to 33 mass % or less, further preferably, in the range of 28 mass % or more to 32 mass % or less. If the content of R is less than 25 mass %, it is not sufficient to produce the $R_2T_{14}B$ compound which becomes a main phase of R-T-B based sintered magnet. With this, there is a possibility that the magnetic properties are deteriorated since α-Fe having a soft magnetism is formed. If the content of R is 35 mass % or more, favorable magnetic properties cannot be obtained since a volume ratio of the main phase decreases. Therefore, if the content of R is within the above range, favorable magnetic properties can be obtained.

The content of B is preferably in the range of 0.5 mass % or more to 1.5 mass % or less, more preferably in the range of 0.5 mass % or more to 1.3 mass % or less, further preferably in the range of 0.8 mass % or more to 1.2 mass % or less. When the content of B is less than 0.5 mass %, the coercivity HcJ decreases. Further, when the content of B exceeds 1.5 mass %, the residual magnetic flux density tends to decrease. Therefore, when the content of B is within the above range, it enables to suppress a decrease of the coercivity HcJ and the residual magnetic flux density Br.

Further, when a part of Fe is substituted with Co to include Co, the content of Co is preferably suppressed in the range of 0.3 mass % or more to 10 mass % or less of the content of Fe, more preferably in the range of 0.3 mass % or more to 4 mass % or less, further preferably in the range of 0.3 mass % or more to 2 mass % or less, most preferably in the range of 0.3 mass % or more to 1.5 mass % or less. When the content of Fe exceeds 10 mass %, the coercivity HcJ decreases and the material cost increases. Further, when the content of Fe is less than 0.3 mass %, the effect of improved corrosion resistance cannot be obtained.

When including elements such as Al, Ga, Si, Ti, Bi, Sb, Ge, Sn, Zn, V, Cr, Mn, Ni, Cu, Zr, Nb, Mo, Hf, Ta, W in addition to Fe, Co, the content of these elements is preferably in the range that does not substantially exert an influence on saturation magnetization, and it is preferably 5 mass % or less respectively. Further, for the other element inevitably mixed, oxygen (O), nitrogen (N), C, Ca and the like are expected. These elements respectively may be contained in amounts of 0.5 mass % or less.

For the sintered rare earth magnet according to the present embodiment, from the aspect of the magnetic properties, the amount of oxygen is preferably 6000 ppm or less, more preferably 3000 ppm or less, especially preferably 2000 ppm or less. Further, the amount of carbon is preferably 2000 ppm or less, more preferably 1500 ppm or less, especially preferably 1200 ppm or less. Furthermore, the amount of nitrogen is preferably 1000 ppm or less, more preferably 800 ppm or less, especially preferably 600 ppm or less.

The sintered rare earth magnet according to the present embodiment is a magnetic body which is produced by sintering a green compact formed of raw material powders. The green compact can be obtained by forming raw material powders into intended arbitrary predetermined shape by a pressing and the like with use of a press mold, for instance. The shape of the sintered rare earth magnet is not particularly limited, and it can be arbitrary, such as, for instance, tabular, columnar such as quadratic pole, ring-shaped cross-section, C form cylindrical in accordance with the shape of the press mold to be used. For the quadratic pole, for instance, it may be one having a rectangular bottom, or having a square bottom.

The main phase includes a heavy rare earth element. In the present embodiment, the heavy rare earth element means a rare earth element or elements including at least either one of Dy, Tb or both. Further, at least a part of main phase grains of the main phase included in the sintered rare earth magnet includes at least three regions where the concentration of the heavy rare earth elements differs. These three regions are low concentration region, high concentration region, and intermediate region.

FIG. 1 is a schematic diagram briefly showing the composition of the sintered rare earth magnet. As shown in FIG. 1, the main phase 11 has three regions, that is low concentration region 12, high concentration region 13, and intermediate concentration region 14. The main phase 11 includes these three regions so that the three-layered structure is formed in order of low concentration region 12, high concentration region 13 and intermediate concentration region 14.

For the low concentration region 12, the concentration of heavy rare earth elements is the lowest among three regions, low concentration region 12, intermediate concentration region 14, and high concentration region 13.

For the high concentration region 13, the concentration of heavy rare earth elements is the highest among three regions. The high concentration region 13 exists adjacent to at least a part of the low concentration region 12. The high concentration region 13 may exist adjacent to overall periphery of the low concentration region 12.

For the intermediate region 14, the concentration of heavy rare earth elements is higher than the low concentration region 12 and lower than the high concentration region 13. The intermediate concentration region 14 exists adjacent to at least a part of the high concentration region 13. The intermediate concentration region 14 may exist adjacent to overall periphery of the high concentration region 13.

These three regions exist in order of low concentration region 12, high concentration region 13 and intermediate concentration region 14 from the low concentration region 12 toward the grain boundary phase 15 in the main phase 11. By including these three regions of a three-layered structure in the main phase 11 of the sintered rare earth magnet in order of low concentration region 12, high concentration region 13, and intermediate concentration region 14, from the low concentration region 12 toward the grain boundary phase 15, it enables to improve the temperature properties and strength, and also enables to have excellent corrosion resistance.

Further, in the present embodiment, for the temperature properties, it means that it enables to maintain the coercivity HcJ high even in a high temperature environment.

Further, these three regions may be included in the main phase 11 in which the high concentration region 13 is adjacent to at least a part of the low concentration region 12, and the intermediate concentration region 14 is adjacent to at least a part of the high concentration region 13. Furthermore, these three regions may be included in the main phase 11 in which the high concentration region 13 is adjacent to overall periphery of the low concentration region 12, and the intermediate concentration region 14 is adjacent to overall periphery of the high concentration region 13. From the aspect of improvement of magnetic properties, corrosion resistance and strength of the obtained sintered rare earth magnet, it is preferable that the three regions are included in the main phase 11 in which the high concentration region 13 is adjacent to overall periphery of the low concentration region 12, and the intermediate concentration region 14 is adjacent to overall periphery of the high concentration region 13.

Figure 2:
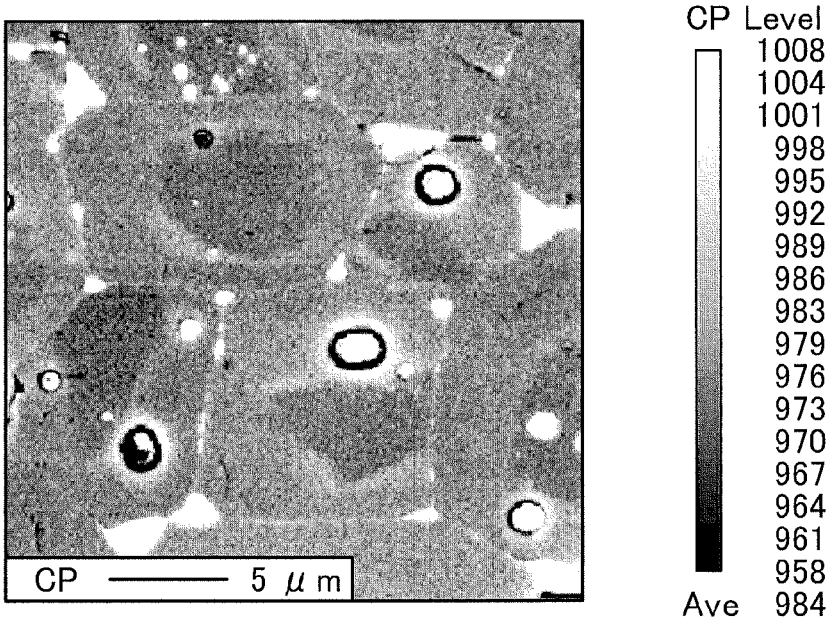
FIG. 2 is a compositional image of the rare earth sintered magnet observed by SEM.
Figure 3:
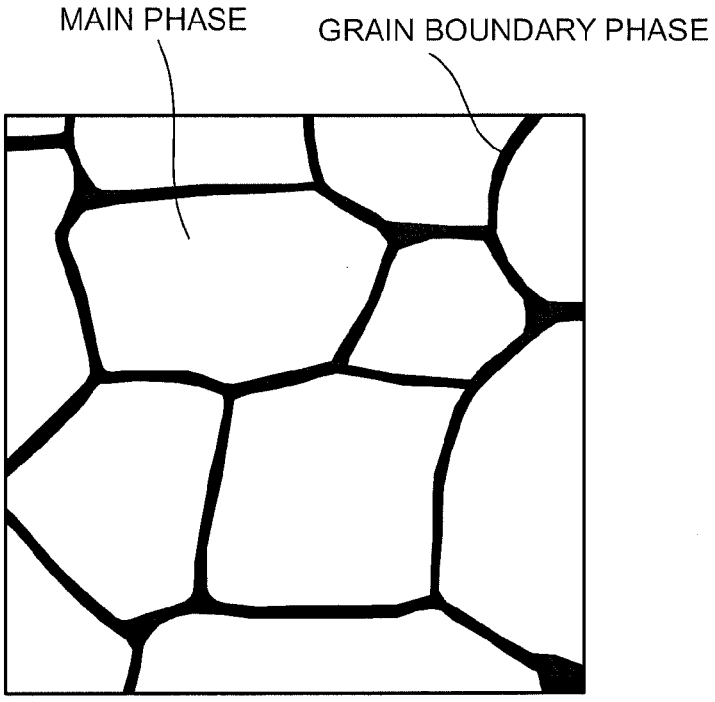
FIG. 3 schematically shows a main phase boundary.
Figure 4:
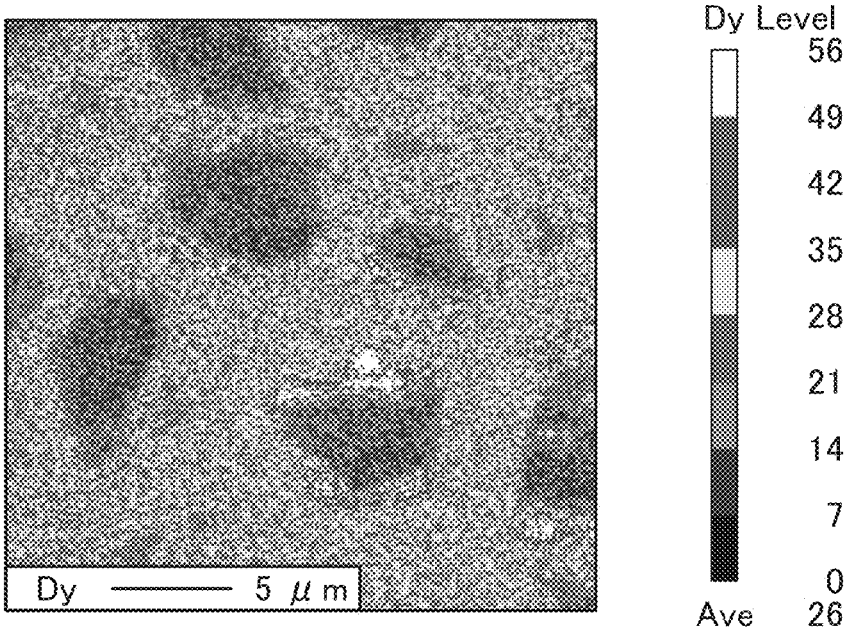
FIG. 4 is an observation result of Dy concentration of the rare earth sintered magnet by EPMA.
Figure 5:
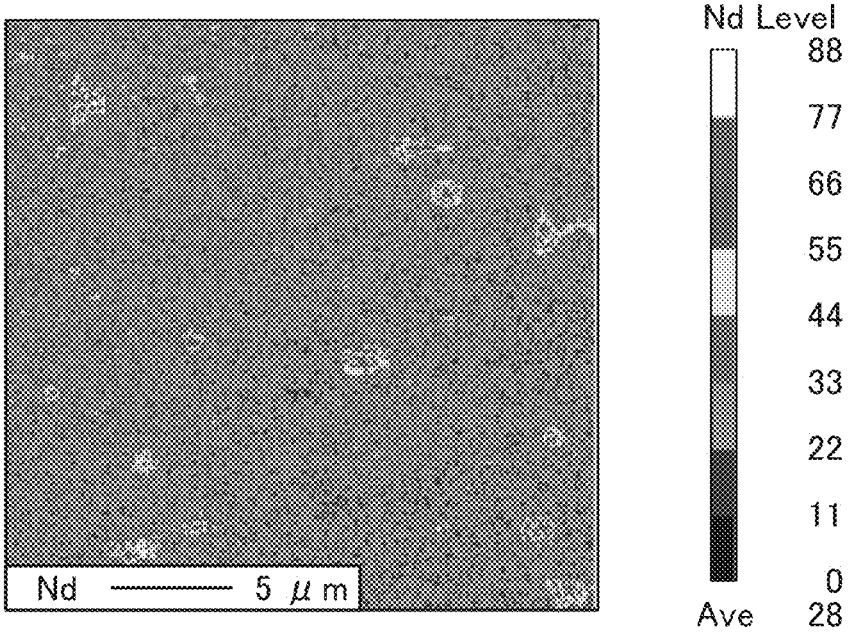
FIG. 5 is an observation result of Nd concentration of the rare earth sintered magnet by PMA.
Figure 6:
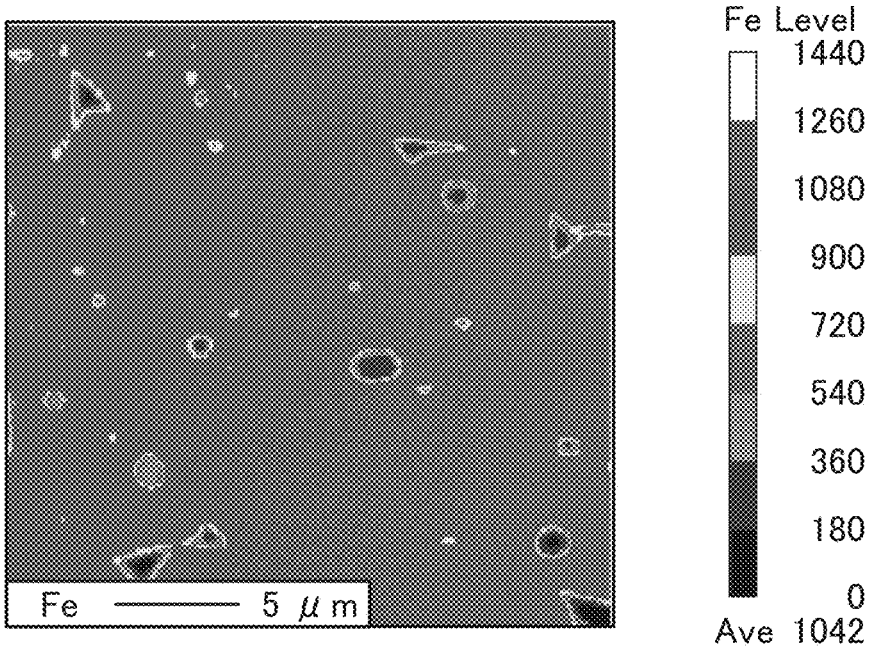
FIG. 6 is an observation result of Fe concentration of the rare earth sintered magnet by EPMA.

In order to confirm a distribution state of Dy, Nd, Co and Fe included in the main phase 11, FIG. 2, and FIGS. 4 to 6 shows a compositional image of the main phase 11 of the sintered rare earth magnet observed by a scanning electron microscope (SEM) and an example of elemental mapping that a composition of the main phase 11 of the sintered rare earth magnet is observed by EPMA. Further, FIGS. 2 to 6 show the same region. FIG. 2 is a compositional image of the sintered rare earth magnet, FIG. 3 schematically shows the main phase boundary, FIG. 4 shows an observation result of Dy concentration of the sintered rare earth magnet by EPMA, FIG. 5 shows an observation result of Nd concentration of the sintered rare earth magnet by EPMA, and FIG. 6 shows an observation result of Fe concentration of the sintered rare earth magnet by EPMA. Further, in FIGS. 4 to 6, white parts indicate that the concentration of the elements is high. Further, said concentration is a detected value of each element observed by EPMA and it does not always correspond to the absolute value of the concentration of each element. The same thing can be said for the below-described line analysis. Further, the black line shown in FIG. 3 is a grain boundary phase which was made based on the compositional image observed by SEM of FIG. 2.

As shown in FIG. 4, the Dy concentration in the main phase includes three regions, low concentration region, high concentration region, and intermediate concentration region. In the main phase, the low concentration region (blue part in FIG. 4) is formed. The high concentration region (red part in FIG. 4) exists contacting to at least a part of or covering overall periphery of the low concentration region. Further, the intermediate concentration region (yellow-green part in FIG. 4) exists contacting to at least a part of or covering overall periphery of the low concentration region (blue part in FIG. 4), or contacting to at least a part of or covering overall periphery of the high concentration region (red part in FIG. 4). By combining the grain boundary phase shown in FIG. 3 with FIG. 4, as shown in FIG. 1, it can be seen that each main phase 11 includes three regions in a state forming a three-layered structure in order of low concentration region 12, high concentration region 13, and intermediate concentration region 14, from the low concentration region 12 toward the grain boundary phase 15.

Further, although the elemental mapping of rare earth sintered magnet including Tb observed by EPMA is not shown, the elemental mapping which is the same with Dy is shown, from the observation result of the rare earth sintered magnet by EPMA, the state of the main phase 11 of the rare earth sintered magnet according to the present embodiment is schematically shown. As shown in FIG. 1, the main phase 11 of the rare earth sintered magnet includes three regions where the concentration of the heavy rare earth elements differs. Further, the three regions include the three-layered structure in order of low concentration region 12, high concentration region 13, and the intermediate concentration region 14, from the low concentration region 12 toward the grain boundary phase 15. In the present embodiment, the high concentration region 13 and the intermediate concentration region 14 exist contacting to at least a part of or an overall periphery of outside of the low concentration region 12 formed in the main phase 11. Therefore, compared with the case that the main phase is entirely formed only by the high concentration region 13, it enables to have an equivalent coercivity HcJ with a small amount of heavy rare earth elements and also enables to improve the residual magnetic flux density Br. With this, it is considered that the rare earth sintered magnet having improved magnetic characteristics can be effectively achieved with less heavy rare earth elements.

In the present embodiment, a part of main phase grains included in the main phase 11 includes at least three regions in accordance with the concentration of the heavy rare earth elements. Therefore, it enables to suppress the movement of magnetic domain wall in reverse magnetic domain by the concentration difference of the heavy rare earth elements in $R_2T_{14}B$ compound that forms the main phase. With this, compared with the cases that the main phase is entirely formed only by the high concentration region 13 or the high concentration region 13 is formed outside of the low concentration region 12, it enables to maintain the coercivity HcJ high even in a high temperature environment. Therefore, it is considered that it enables to further improve the temperature properties of the sintered rare earth magnet.

Further, compared with the light rare earth element such as Nd, the heavy rare earth element generally tends to be oxidized. In the present embodiment, a part of the main phase grain included in the main phase 11 includes at least three regions in accordance with the concentration of the heavy rare earth element, and the intermediate concentration region 14 is formed near the grain boundary phase 15 of the main phase 11. Therefore, compared with the case that the main phase 11 is entirely formed only by the high concentration region 13 or the case that the main phase includes the high concentration region 13 formed outside of the low concentration region 12, the concentration of the heavy rare earth elements in the main phase 11 is relatively low. Specifically, it is considered that it enables to improve the corrosion resistance of the sintered rare earth magnet.

Further, for the sintered rare earth magnet having the main phase 11 composed of $R_2T_{14}B$ compound, it is easily fractured and destroyed at the interface mainly between the grain boundary phase 15 and the main phase 11. Therefore, it can be said that the interface state between the main phase 11 and the grain boundary phase 15 exerts an influence on the overall strength of the sintered rare earth magnet. In the present embodiment, the main phase 11 includes three regions in accordance with the concentration of the heavy rare earth elements. Further, the main phase 11 exists in a state that the three-layered structure of three regions is formed in order of low concentration region 12, high concentration region 13, and intermediate concentration region 14, from the low concentration region 12 toward the grain boundary phase 15. Specifically, it is considered that it enables to increase the strength of the sintered rare earth magnet since the interface state between the main phase 11 and the grain boundary phase 15 is improved.

Therefore, according to the sintered rare earth magnet of the present embodiment, a part of main phase grain included in the main phase 11 includes three regions in a three-layered structure in order of the low concentration region 12, high concentration region 13, and the intermediate region 14, from the low concentration region 12 toward the grain boundary phase 15. With this, it enables to effectively distribute the heavy rare earth element in the main phase 11 and also enables to maintain the coercivity HcJ high even in a high temperature environment. As a result of this, the sintered rare earth magnet according to the present embodiment enables to improve the temperature properties and the strength and also enables to have an excellent corrosion resistance.

Further, for the sintered rare earth magnet according to the present embodiment, at least a part of main phase grain of the main phase 11 includes at least three regions. Therefore, for the sintered rare earth magnet according to the present embodiment, compared with magnets formed by the main phase which is entirely formed only by the high concentration region 13 or magnets formed by the main phase which includes the high concentration region 13 outside of the low concentration region 12, the sintered rare earth magnet having the equivalent coercivity HcJ can be produced with a small amount of heavy rare earth elements. Therefore, it enables to reduce costs required for producing the sintered rare earth magnet.

Further, a part of the main phase grain included in the main phase 11 includes three regions, in a state of forming the three-layered structure wherein the high concentration region 13 is adjacent to at least a part of the low concentration region 12, and the intermediate concentration region 14 is adjacent to at least a part of the high concentration region 13. In this case, the main phase forming the above three-layered structure preferably exists 5% or more in the sintered rare earth magnet, and more preferably 30% or more. It enables stably to obtain the characteristics of the obtained sintered rare earth magnet, by including a predetermined amount of the main phase grains that forms the above three-layered structure in the sintered rare earth magnet.

Further, a part of the main phase grains included in the main phase 11 includes three regions, preferably in a state of forming the three-layered structure wherein the high concentration region 13 is adjacent to overall periphery of the low concentration region 12, and the intermediate region 14 is adjacent to the overall periphery of the high concentration region 13. In this case, the main phase grains forming this three-layered structure preferably exist 3% or more in the sintered rare earth magnet, more preferably 5% or more. The three regions are included in the main phase grains, in a state that they are circumferentially formed in order of the low concentration region 12, the high concentration region 13 and the intermediate concentration region 14, from the low concentration region 12 toward the grain boundary phase 15. By including the predetermined amount of main phase grains that forms the above three-layered structure in the sintered rare earth magnet, it enables further stably to increase the characteristics of the obtained sintered rare earth magnet.

Further, in the present embodiment, it is preferable that a relative density of the sintered rare earth magnet is 99% or more. The concentration difference of the heavy rare earth elements is easily caused as the relative density of the sintered rare earth magnet gets high. Therefore, it enables stably to form the sintered rare earth magnet that includes a lot of main phase grains wherein three regions are formed in a three-layered structure in order of the low concentration region 12, the high concentration region 13, and the intermediate concentration region 14, from the low concentration region 12 of the main phase grain toward the grain boundary phase 15, in accordance with the concentration of the heavy rare earth elements. Further, the relative density of the sintered rare earth magnet is a value that a measured density of the sintered rare earth magnet is divided by a theoretical density of the sintered rare earth magnet.

Further, in the present embodiment, the average value of the concentration of the heavy rare earth elements in the intermediate region 14 shall be obtained by the average value of the concentration of the heavy rare earth elements, from the maximum concentration of the heavy rare earth elements to the grain boundary phase 15. The average value of the concentration of the heavy rare earth elements in the intermediate concentration region 14 which is formed from the high concentration region 13 toward the grain boundary phase 15 becomes clear.

Further, at this point, for the average value of the concentration of the heavy rare earth elements in the intermediate concentration region 14, it is preferably within a predetermined range, in a relationship between a minimum concentration of the heavy rare earth elements in the low concentration region of the main phase grains and a maximum concentration of the heavy rare earth element in the high concentration region 13 of the main phase grains.

Figure 10:
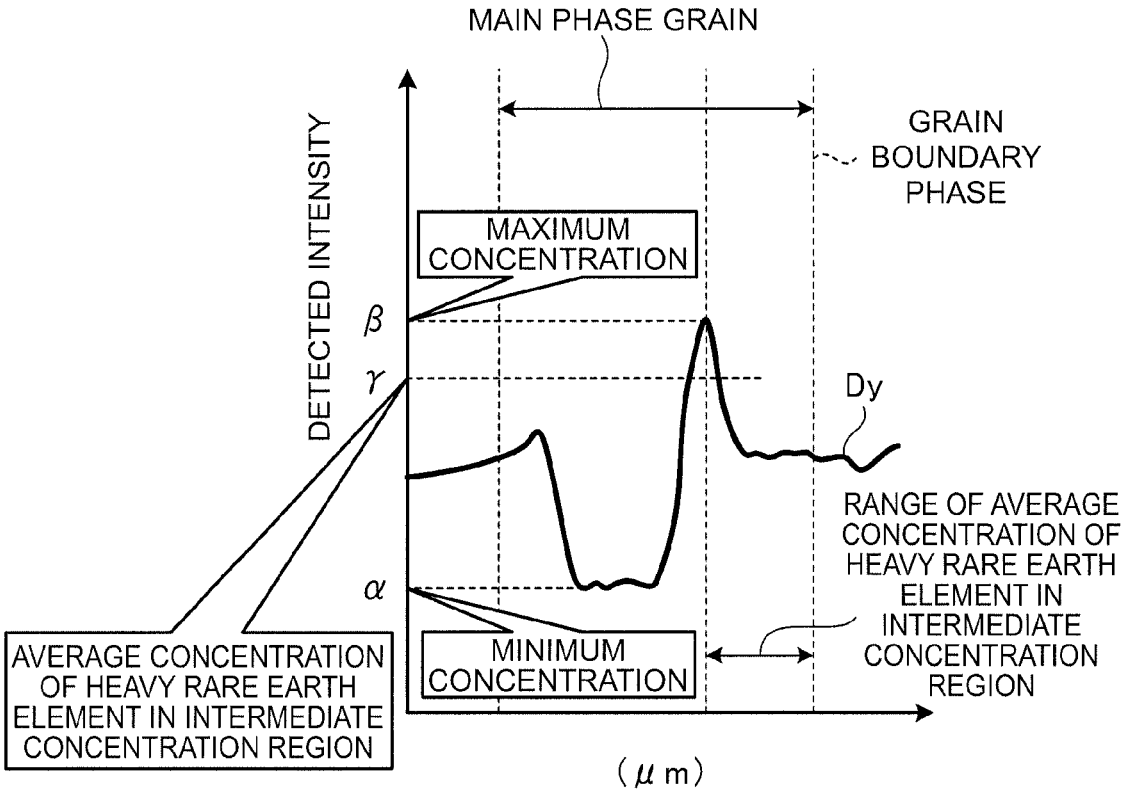
FIG. 10 is an explanation indicating an example of line analysis result.

Specifically, as shown in FIG. 10, when implementing a line analysis by EPMA on the region where the low concentration region 12, the high concentration region 13, and the intermediate region 14 exist in the main phase grains, the minimum concentration of the heavy rare earth elements in the main phase grains is represented as a, the maximum concentration of the heavy rare earth elements in the main phase grains is represented as (3, and the average value of the concentration of the heavy rare earth elements in the intermediate region 14 is represented as γ. The average value of the concentration of the heavy rare earth element in the intermediate region 14 is expressed by the following formula (A).

$$(\gamma-\alpha)/(\beta-\alpha) \qquad \text{formula (A)}$$

The value obtained by the above formula (A) is preferably in the range of 0.2 or more to 0.8 or less, more preferably in the range of 0.3 or more to 0.75 or less, further preferably in the range of 0.35 or more to 0.7 or less. When the average value of the concentration of the heavy rare earth elements in the intermediate region 14 is 0.8 or higher, it is difficult to improve the temperature properties and the strength of the obtained sintered rare earth magnet and also to improve the corrosion resistance, since the structure of the main phase gets closer to the case that the main phase including a region where the rare earth concentration is higher than the low concentration region is formed outside of the low concentration region. Further, when the average value of the concentration of the heavy rare earth elements in the intermediate concentration region 14 is 0.2 or less, the amount of the heavy rare earth elements in the main phase grain gets low. Therefore, it becomes difficult for the obtained sintered rare earth magnet to have a favorable coercivity HcJ. As a result, the obtained sintered rare earth magnet cannot have favorable temperature properties.

Therefore, when the average value of the concentration of the heavy rare earth elements in the intermediate concentration region 14 is within the above range, the three-layered structure in order of low concentration region 12, high concentration region 13, and intermediate region 14 becomes clearer, in accordance with the concentration of the heavy rare earth elements, from the low concentration region 12 of the main phase grain toward the grain boundary phase 15. With this, it enables to improve the temperature properties and the strength of the obtained sintered rare earth magnet and also enables stably to obtain an excellent corrosion resistance.

Figure 7:
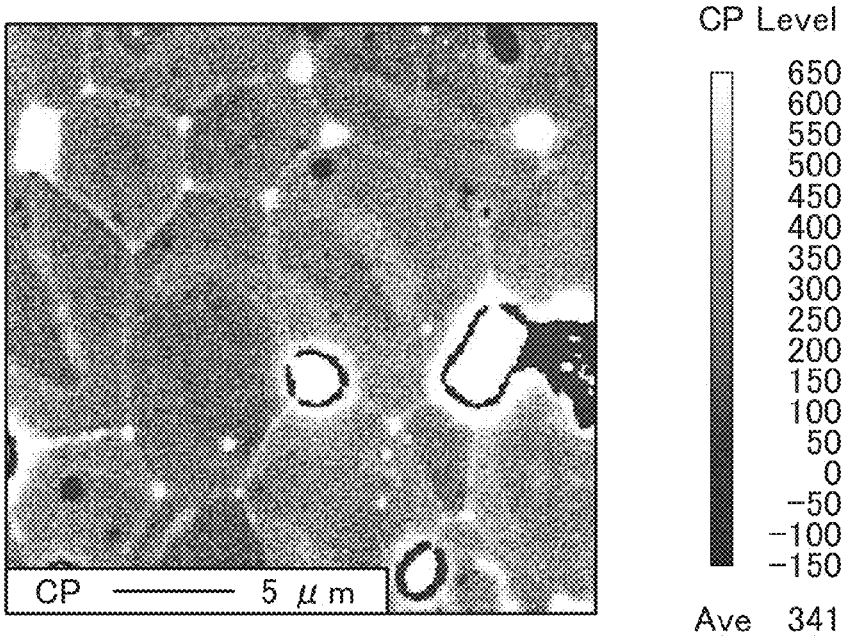
FIG. 7 shows an example of compositional image of the rare earth sintered magnet.
Figure 8:
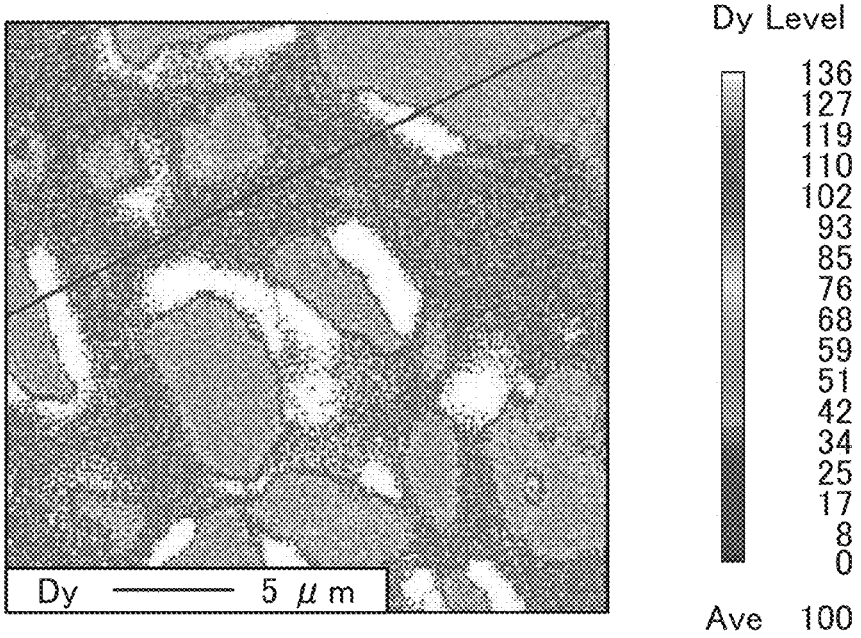
FIG. 8 shows an observation result of Dy in a compositional image of FIG. 7 by EPMA.
Figure 9:
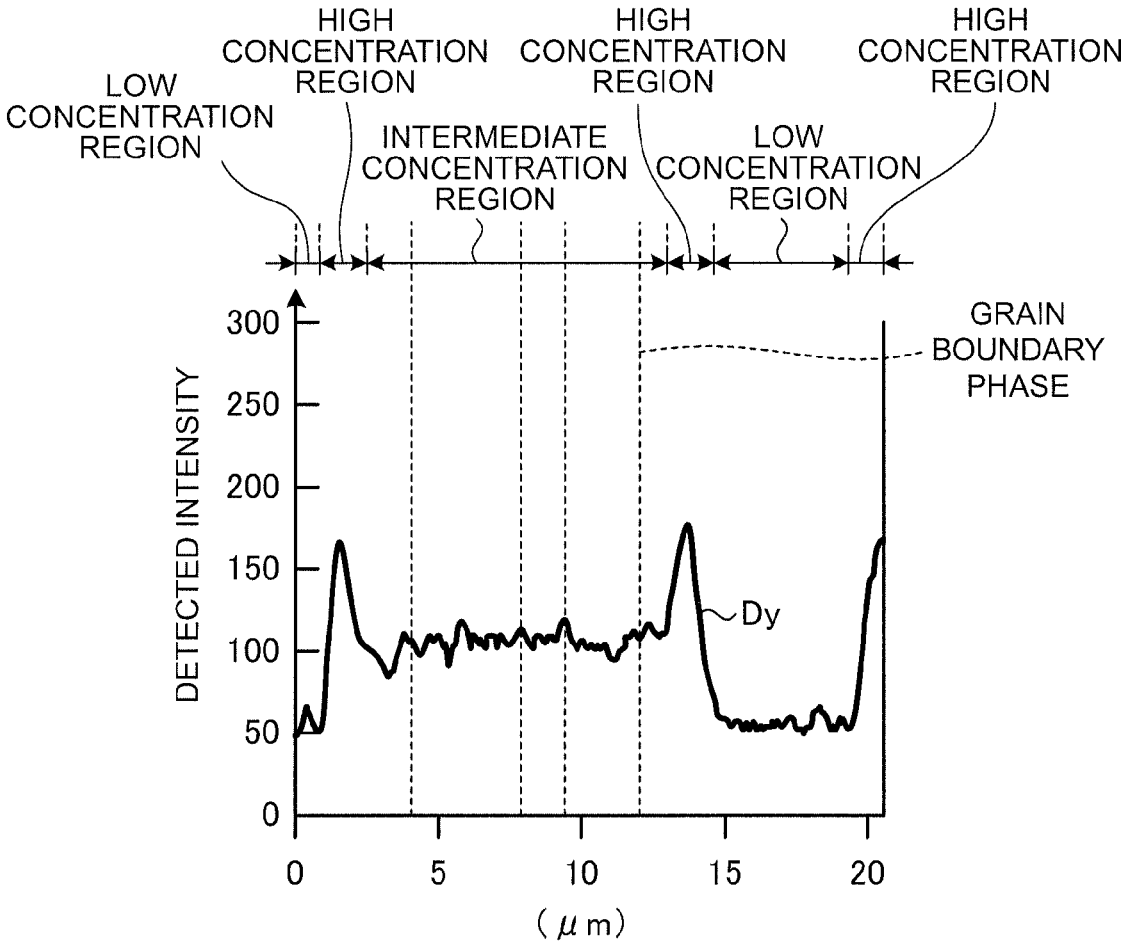
FIG. 9 shows a result of detected strength of Dy when a line analysis is performed on a straight line shown by EPMA in FIG. 8.

FIG. 7 shows an example of compositional image of the sintered rare earth magnet, FIG. 8 shows an observation result of Dy by EPMA in the same region, and FIG. 9 shows a result of detected intensity of Dy when the line analysis is performed on the observation result by EPMA. Further, FIG. 9 shows relative detected intensity of Dy, and it is an analysis of composition by size that the line length 20 μm shown in FIG. 8 is divided into 256. For the compositional image shown in FIG. 7, by performing the line analysis on the EPMA line of Dy as shown in FIG. 8, the detected intensity according to the three-layered structure of high concentration region, intermediate concentration region, and low concentration region in accordance with Dy concentration can be obtained as shown in FIG. 9. Furthermore, FIG. 9 clearly shows the grain boundary phase, the low concentration region, the intermediate concentration region, and the high concentration region by reference to FIGS. 7 and 8.

When the line analysis is performed on the main phase grain by EPMA, a minimum concentration of the heavy rare earth elements in the main phase is represented by a, a maximum concentration of the heavy rare earth elements in the main phase is represented by β, and the average value of concentration of the heavy rare earth elements in the intermediate concentration region is represented by γ. At this time, when the value of the above formula (A) is within a predetermined range, it enables to further improve the effects of the present invention since the three-layered structure in accordance with the concentration of the heavy rare earth elements is clearly formed.

Further, in FIG. 8 and FIG. 9, it is explained that the heavy rare earth element is Dy. However, if the heavy rare earth element is Tb and the like, the same thing can be explained.

Further, the average value of the heavy rare earth element in the intermediate concentration region is preferably in the range of 0.2 or more to 0.8 or less, more preferably in the range of 0.3 or more to 0.75 or less, and further preferably in the range of 0.35 or more to 0.7 or less. When the average value of the heavy rare earth element in the intermediate concentration region is within the above range, the three-layered structure in order of low concentration region, high concentration region, and intermediate region is clearly formed in accordance with the concentration of the heavy rare earth elements, from the low concentration region in the main phase toward the grain boundary phase. Therefore, it enables to maintain the corcivity HcJ high even in a high temperature environment. As a result of this, it enables to further improve the temperature properties of the obtained sintered rare earth magnet. Further, it enables to further improve the strength of the obtained sintered rare earth magnet and also enables to further improve the corrosion resistance, and thereby it enables to further improve the effects of the present invention.

<Production Method for Sintered Rare Earth Magnet>

Figure 11:
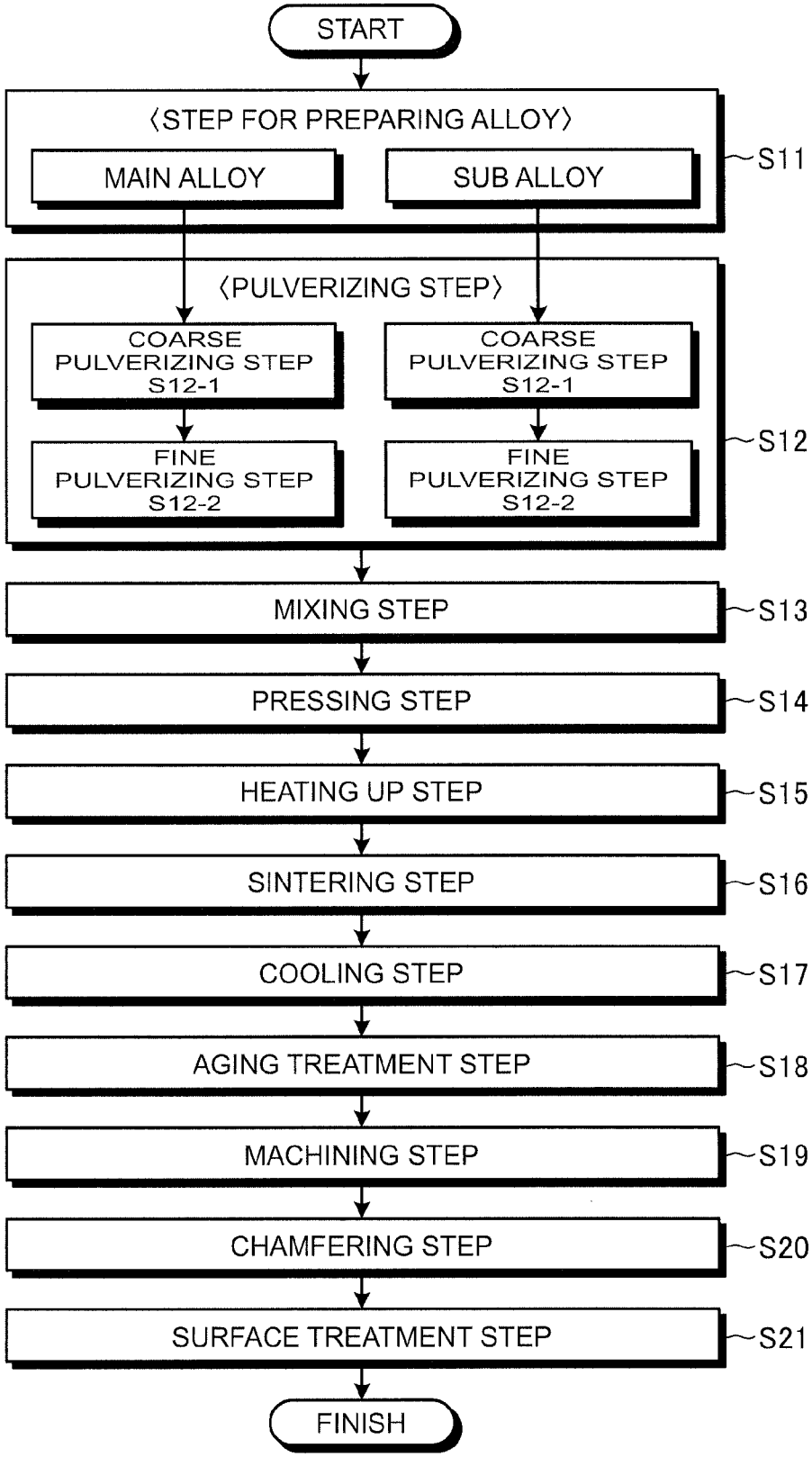
FIG. 11 is a flow chart showing an example of production method of the rare earth sintered magnet according to embodiments of the present invention.

The followings are the explanation about a favorable production method for the sintered rare earth magnet according to the present embodiment having the above mentioned configuration. For the sintered rare earth magnet according to the present embodiment, it is produced by using alloy having a composition mainly composing a main phase (main alloy) and also alloy having a composition mainly composing a grain boundary phase (sub alloy). FIG. 11 is a flow chart showing an example of production method of the sintered rare earth magnet according to the embodiment of the present invention.

<A Step for Preparing Alloy: Step S11>

As shown in FIG. 11, first, alloy having a composition mainly composing a main phase (main alloy) and also alloy having a composition mainly composing a grain boundary phase (sub alloy) are prepared (a step for preparing alloy (step S11)). In the step for preparing alloy (step S11), raw material metal corresponding to a composition of the sintered rare earth magnet is dissolved in an inert gas atmosphere such as vacuum or Ar gas for casting, and then the main alloy and the sub alloy having a desired composition are produced.

As for raw material metal, for instance, rare earth metal or rare earth alloy, pure iron, ferro-boron, and also alloys and compounds thereof can be used. The main alloy includes $R_2T_{14}B$ compound and inevitable impurities. For the $R_2T_{14}B$ compound, it is as mentioned above. Further, the sub alloy includes HR (HR represents one or more of rare earth element including at least either one of Dy, Tb or both), T, and inevitable impurities. Further, as the sub alloy, oxide, fluoride and hydride of HR and so on may be used.

For the method of casting raw material alloys, for instance, a strip casting method, a book molding method, and a centrifugal casting method are exemplified. The obtained raw material metals are homogenized as necessary, when the solidification segregation is found. When homogenizing the raw material metal, it should be performed in vacuum or in an inert gas atmosphere, maintaining temperature in the range of 700° C. or more to 1500° C. or less for more than one hour. With this, a part of alloys for the rare earth magnet is melted and is homogenized.

<Pulverizing Step: Step S12>

After producing the main alloy and the sub alloy, they are pulverized [pulverizing step (step S12)]. In a pulverizing step (step S12), after producing the main alloy and the sub alloy, they are separately pulverized. Further, the main alloy and the sub alloy may be mixed and pulverized.

For the pulverizing step (step S12), it includes a coarse pulverizing step (step S 12-1) that coarsely pulverizes until the particle size becomes about several hundred μm, and a fine pulverizing step (step S 12-2) that finely pulverizes until the particle size becomes about several μm.

(Coarse Pulverizing Step: Step S 12-1)

The main alloy and the sub alloy are coarsely pulverized so that each particle size becomes in the range of several hundred μm or more to several mm or less (coarse pulverizing step (step S12-1)). With this, it enables to obtain coarse pulverized powders of the main alloy and the sub alloy. For the coarse pulverization, for instance, hydrogen may be stored in the main alloy and the sub alloy and then these alloys may be heated in an inert gas atmosphere. With this, it enables to coarsely pulverize the alloys resulting from a self-collapse based on the different amount of hydrogen storage among different phases.

Further, when performing coarse pulverization, it may be mechanically-pulverized in the inert gas atmosphere by using stamp mill, jaw crusher, brown mill and the like. However, it is preferable that the coarse pulverization by absorption and release of hydrogen are combined to be used in order to sufficiently obtain the effects of the rare earth sintered magnet according to the present embodiment.

Further, in order to obtain high magnetic properties, it is preferable that the atmosphere in each step from the pulverizing step (step S 12) to a sintering step (step S 16) described below is a low oxygen concentration. For the content of oxygen, it is adjusted by controlling the atmosphere, the amount of oxygen contained in raw materials and the like in each production step. For instance, when the amount of oxygen contained in a sintered body which can be obtained in the sintering step (step S16) is 5000 ppm or less, it is preferable that the concentration of oxygen in each step is 3000 ppm or less. Further, when the amount of oxygen contained in the sintered body is 3000 ppm or less, it is preferable that the concentration of oxygen in each step is 100 ppm or less.

(Fine Pulverizing Step: Step S 12-2)

After coarsely pulverizing the main alloy and the sub alloy, the obtained coarse pulverized powder thereof is finely pulverized until the average particle size becomes about several μm (fine pulverizing step (step A12-2)). With this, it enables to obtain fine pulverized powders of the main alloy and the sub alloy. By further finely pulverizing the coarse pulverized powders, it enables to obtain mixed powders (hereinafter simply referred to as "mixed powders") of the rare earth sintered body having a particle size preferably in the range of 1 μm or more to 10 μm or less, more preferably in the range of 3 μm or more to 5 μm or less.

For the fine pulverization, it is performed so that the coarse pulverized powders are further pulverized by using a fine pulverizer such as a jet mill, a ball mill, a vibrating mill, a wet attritor and the like, with appropriately adjusting the conditions such as pulverization time. For the jet mill, it generates high-speed gas flow by releasing high-pressure inert gas (for example, $N_2$ gas) from a narrow nozzle to accelerate the coarse pulverized powders of the main alloy and the sub alloy by the high-speed gas flow, so that an impact of the coarse pulverized powders of the main alloy each other and an impact of the coarse pulverized powders of the sub alloy each other and also an impact of powders with a target or a container wall are caused for pulverizing.

It enables to obtain fine pulverized powders which can be highly-oriented during the pressing step by adding pulverizing agent such as zinc stearate, oleic amide and so on, when finely pulverizing the coarse pulverized powders of the main alloy and the sub alloy.

<Mixing Step: Step S13>

After finely pulverizing the main alloy and the sub alloy, these finely pulverized powders are mixed in a low-oxygen atmosphere (mixing step (step S13)). With this, it enables to obtain mixed powders. The low-oxygen atmosphere, for instance, is formed as inert gas atmosphere such as $N_2$ gas, Ar gas atmosphere and the like. The mixing ratio of the main alloy powders and the sub alloy powders is preferably in the range of 80-20 to 97-3 by a mass ratio, more preferably in the range of 90-10 to 97-3 by a mass ratio, further preferably in the range of 95-5 by a mass ratio.

Further, in the pulverizing step (step S12), the compounding ratio when mixing and pulverizing the main alloy and the sub alloy is the same with when separately pulverizing the main alloy and the sub alloy. Specifically, the compounding ratio of the main alloy powders and the sub alloy powders is preferably in the range of 80-20 to 97-3 by a mass ratio, more preferably in the range of 90-10 to 97-3 by a mass ratio, further preferably in the range of 95-5 by a mass ratio.

<Pressing Step: Step S14>

After mixing the main alloy powders and the sub alloy powders, the mixed powders are pressed into an objective shape (pressing step (step S14)). In the pressing step (step S14), the mixed powders of the main alloy powders and the sub alloy powders are filled in a press mold with electromagnet and are pressed, so that the mixed powders are formed into an arbitrary shape. At this time, by performing the pressing step under applying a magnetic field, a predetermined orientation is generated on the raw material powders and thereby the powders are pressed in a state that a crystal axis is oriented. With this, a green compact can be obtained. The obtained green compact is oriented in a particular direction. Therefore, it enables to obtain a sintered rare earth magnet with a stronger magnetic anisotropy. Further, it is preferable to apply the magnetic field before pressing, and it is more preferable to continue to apply the magnetic field during pressing as well.

For the pressure when pressing, it is preferably performed in the range of 50 MPa or more to 200 MPa or less. For the application of the magnetic field, it is preferably performed in the range of 950 kA/m or more to 1600 kA/m or less. The magnetic field to be applied is not limited to a static magnetic field, and it may be a pulsed magnetic field. Further, the static magnetic field and the pulsed magnetic field can be combined.

Further, as a pressing method, there can be a dry pressing that the mixed powders are directly pressed as above, and a wet pressing that a slurry including the raw material powders dispersed in a solvent such as oil is pressed.

The shape of the green compact obtained by pressing the mixed powders is not particularly limited, and it may be arbitrary shaped in accordance with the desired shape of the sintered rare earth magnet, such as a cuboid, tabular, columnar, ring-shaped cross-section and the like, according to the shape of the press mold to be used.

<Heating Up Step: Step S 15>

Pressing is performed in the magnetic field and thereby obtained green compact which is pressed into an objective shape is heated up in vacuum or in an inert gas atmosphere. The average heating rate from 600° C. to a sintering temperature is in the range of 2° C./min or more to 10° C./min or less (heating up step (step S15)). In the present embodiment, when heating the green compact, the average heating rate from 600° C. to the sintering temperature is preferably in the range of 3° C./min or more to 9° C./min or less, more preferably in the range of 4° C./min or more to 7° C./min or less, further preferably around 6° C./min. When heating the green compact, by determining the average heating rate from 600° C. to the sintering temperature within the above range, it enables to form a three-layered structure in the main phase of the sintered rare earth magnet since the concentration difference of the heavy rare earth elements included in the main phase of the obtained sintered rare earth magnet is easily caused.

<Sintering Step: Step S16>

Pressing is performed in the magnetic field and thereby obtained green compact which is pressed into an objective shape is sintered in vacuum or in an inert gas atmosphere (sintering step (step S16)). The sintering temperature needs to be adjusted in accordance with the conditions such as the differences of composition, pulverizing method, grain size, grain distribution and the like. For instance, the green compact is sintered by heating at 1000° C. or more to 1200° C. or less for an hour to ten hours in vacuum or in an inert gas atmosphere. With this, the density is rised and it enables to obtain the sintered body (a sintered body of the sintered rare earth magnet)

<Cooling Step: Step S17>

After sintering the shape formed article, the sintered body is cooled by using inert gas, preferably, Ar gas (cooling step (step S17)). In the present embodiment, the average cooling rate until less than 600° C. is in the range of 3° C./min or more to 20° C./min or less, preferably in the range of 5° C./min or more to 15° C./min or less, more preferably in the range of 10° C./min or more to 15° C./min or less. When cooling the sintered body, it is considered that the three-layered structure can be formed in the main phase of the rare earth sintered magnet by determining the average cooling rate until less than 600° C. within the above range, since the concentration difference of the heavy rare earth elements included in the main phase of the obtained rare earth sintered magnet is likely to be caused. With this, it enables to obtain a rare earth sintered magnet according to the present embodiment. With this, it enables to obtain a rare earth sintered magnet according to the present embodiment. Further, the cooling rate at less than 600° C. is not particularly limited, and cooling is performed until 200° C. or less.

<Aging Treatment Step: Step S18>

Following the cooling step (step S17), an aging treatment is performed on the rare earth sintered magnet (aging treatment step (step S18)). The aging treatment is to perform a heat treatment at lower temperature than the sintering temperature for a certain period of time with respect to magnets after sintering. The aging treatment is performed under the non-oxidizing atmosphere. For instance, there are heating methods such as two-steps heating that the sintered body is heated at 700° C. or more to 900° C. or less for an hour to three hours and then is cooled to 200° C. or less, and further is heated at 500° C. or more to 700° C. or less for an hour to three hours, and one-step heating that the sintered body is heated at around 600° C. for an hour to three hours. The treatment condition is appropriately adjusted in accordance with the number of times performing the aging treatment.

<Machining Step: Step S19>

Next, after performing the aging treatment on the sintered rare earth magnet, the sintered rare earth magnet is machined so that it is formed into arbitrary shape, by cutting off into a desired size and smoothing out the surface, for instance, by means of punching, cutting, grinding and so on (machining step: step S19).

<Chamfering Step: Step S20>

Next, a barrel polishing is performed on the sintered rare earth magnet obtained in the machining step (step S19) by using barrel to perform chamfering (chamfering step (step S20)).

Further, in the present embodiment, after the machining to form the sintered rare earth magnet into more arbitrary shape, chamfering is performed. However, it is not limited to this, and the sintered rare earth magnet having a predetermined shape may be obtained by cutting into the desired size or smoothing out the surface, after chamfering is performed on the sintered rare earth magnet obtained in the aging treatment step (step S18).

<Surface Treatment Step: Step S21>

Next, after polishing the sintered rare earth magnet in the chamfering step (step S20), the surface of the sintered rare earth magnet according to the present embodiment is cleaned by acid for a predetermined time by using nitric acid. After that, Ni plating is performed to form Ni plating films on the surface of the sintered rare earth magnet according to the present embodiment (surface treatment step (step S21)). As acid solutions used for acid cleaning for the surface of the sintered rare earth magnet, mixed solutions in which water solutions such as nitric acid, hydrochloric acid and the like and alcohol are mixed are preferable. For the surface treatment, it can be performed by, for instance, immersing the sintered rare earth magnet in the acid solution and spraying the sintered rare earth magnet with the acid solution.

With such acid cleaning, it enables to remove dirt adhering to the rare earth sintered magnet, oxidized layer and the like, and thereby a clean surface can be obtained. From the aspect of performing a removal of dirt, oxidized layer and the like in a better way, the acid cleaning may be performed while applying ultrasonic waves to the acid solution.

Further, in the present embodiment, Ni plating films are formed on the surface of the sintered rare earth magnet to perform the surface treatment. However, it is not limited to this. For instance, corrosion resistance may be improved by applying a surface modification method by oxidation, nitridation, and chemical treatment, resin coating and the like, in addition to or instead of applying Ni plating.

Further, in the present embodiment, machining step (step S19), chamfering step (step S20) and surface treatment step (step S21) are performed. However, each step is not necessarily performed.

The sintered rare earth magnet is produced as mentioned above. Further, magnetic products can be obtained by magnetizing the obtained sintered rare earth magnet.

Further, the content of C contained in the sintered rare earth magnet is adjusted in accordance with the kinds, additive amounts and the like of pulverizing agent to be used in production step. Further, the content of N contained in the sintered rare earth magnet is adjusted in accordance with the kinds and the amount of raw material alloy and the pulverizing condition when pulverizing the raw material alloy in a nitrogen atmosphere.

The sintered rare earth magnet obtained as above includes the main phase composed of $R_2T_{14}B$ (R represents one or more of rare earth element including either one of Nd, Pr or both as main component, and T represents one or more of transition metal element including Fe or Fe and Co) compound. At least a part of the main phase grain of the main phase included in the sintered rare earth magnet includes either one of Dy, Tb or both, also includes three regions where the concentration of either one of Dy, Tb or both differs, and further includes the above three regions in order of low concentration region, high concentration region, and intermediate concentration region in accordance with the concentration of either one of Dy, Tb or both, from the low concentration region toward the grain boundary phase.

In view of the above, for the obtained sintered rare earth magnet according to the present embodiment, at least a part of the main phase grain included in the main phase includes at least three regions in order of low concentration region, high concentration region, and intermediate region, from the low concentration region toward the grain boundary phase, in accordance with the concentration of the heavy rare earth elements. Therefore, it enables to maintain the coercivity HcJ high even in a high temperature environment. As a result, it enables to improve the temperature properties of the obtained sintered rare earth magnet. Further, it enables to improve the strength of the obtained sintered rare earth magnet and also enables to have an excellent corrosion resistance. Accordingly, by applying the production method of the sintered rare earth magnet according to the present embodiment, it enables to cope with the high temperature environment and also enables to produce the sintered rare earth magnet having high reliability which can be stably used for thinner and smaller products.

The sintered rare earth magnet according the present embodiment obtainable as above is preferably used as magnets, for instance, such as surface permanent magnet (SPM) motors provided with magnets on the surface of the rotor, interior permanent magnet (IPM) motors like inner rotor type brushless motors, permanent magnet reluctance motors (PRM) and the like. Particularly, IPM motors have advantages that cogging torque is small and the like. Therefore, it is favorably used for the purpose of motors for electric vehicles and hybrid cars, motors for electric power steering of motorcars, motors for magnetic field source such as magnetic resonance imaging system (MRI), spindle motors for hard disc rotational drive, voice coil motors for hard disc head drive, servomotors for a machine tool, motors for vibrator of mobile phone, motors for printer and the like.

Further, in the present embodiment, as explained above, the main phase grain includes three regions, low concentration region, high concentration region and intermediate concentration region. However, it is not limited to the above as long as the main phase grain includes at least three regions. The main phase grain may include a plurality of intermediate concentration regions respectively having different concentrations, in addition to the high concentration region and the low concentration region.

As above, a favorable embodiment of the sintered rare earth magnet according to the present embodiment is explained. However, the sintered rare earth magnet according to the present embodiment is not limited to this. The sintered rare earth magnet according to the present embodiment can be variously deformed and combined without departing from its point, and also can be equivalently applied other than permanent magnets.

<Motors>

Figure 12:
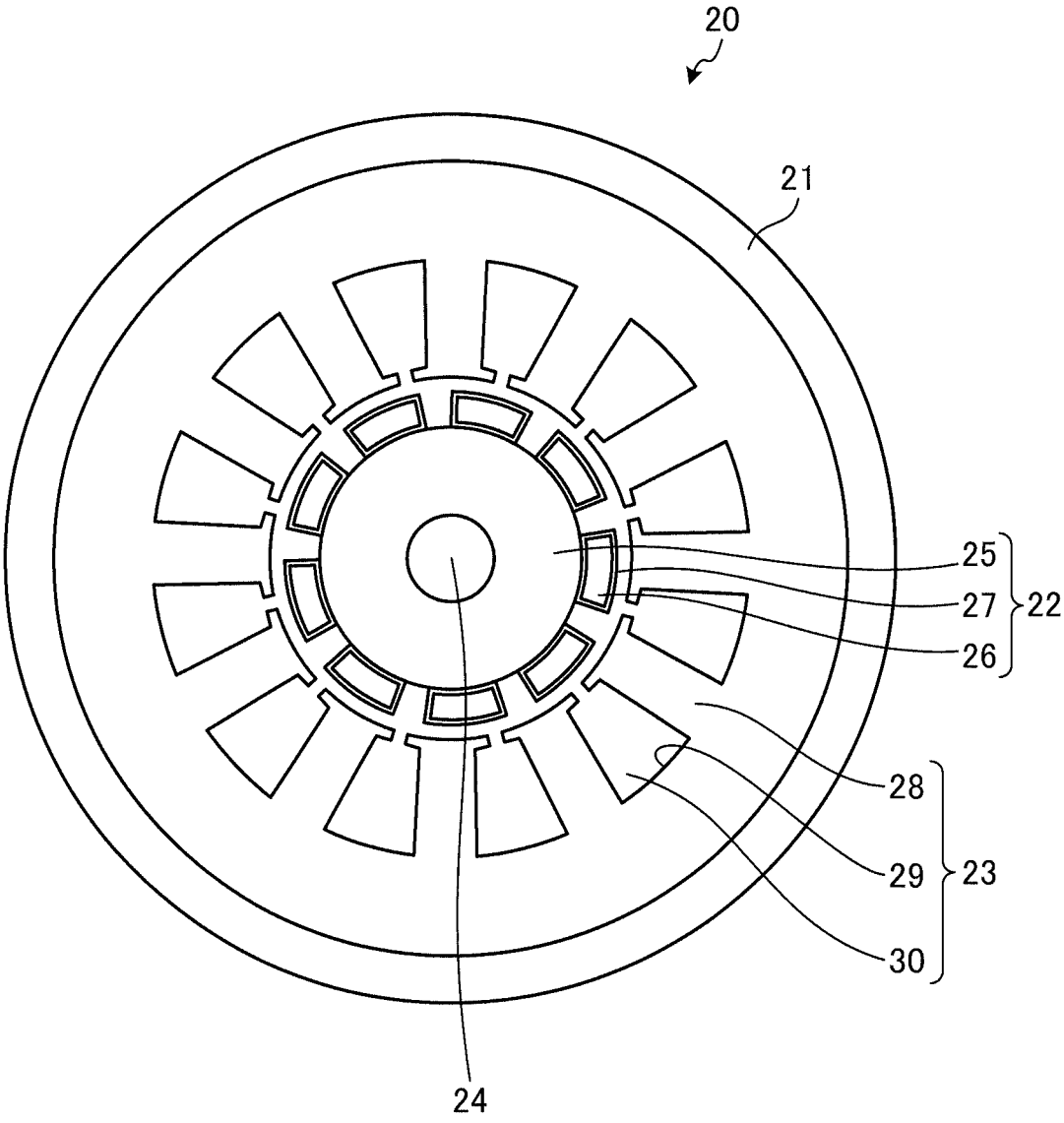
FIG. 12 is a cross-sectional view briefly showing the structure of SPM motor in one embodiment.

The followings are the explanation regarding a favorable embodiment that the sintered rare earth magnet according to the present embodiment is used for motors. Here, an example that the sintered rare earth magnet according to the present embodiment is applied to SPM motor is explained. FIG. 12 is a cross-sectional view briefly showing a configuration of one embodiment of SPM motor. As shown in FIG. 12, SPM motor 20 has a columnar rotor 22, cylindrical stator 23, and a rotary shaft 24 in a housing 21. The rotary shaft 24 penetrates through the center of the cross-section of the rotor 22. The rotor 22 has a columnar rotor core (iron core) 25 made of iron materials, plural permanent magnets 26 provided on the outer circumference of the rotor core 25 at predetermined intervals, and plural magnet insertion slot 27 housing the permanent magnets 26. For the permanent magnets 26, the sintered rare earth magnets according to the present embodiment are used. These plural permanent magnets 26 are provided in such a manner that N-pole and S-pole are alternately arranged in each magnet insertion slot 27 along the circumferential direction of the rotor 22. With this, the permanent magnets 26 adjacent to each other along the circumferential direction respectively produce reversely-oriented magnetic field lines along the radial direction of the rotor 22. The stator 23 has a plurality of stator cores 28 and throttles 29, which are provided along the outer circumference of the rotor 22, in the inner circumferential direction inside of the cylinder wall (peripheral wall). These plural stator cores 28 are provided so as to face the rotor 22 toward the center of the stator 23. Further, in each throttle 29, coil 30 is wound. The permanent magnet 26 and the stator core 28 are provided so as to face each other. The rotor 22 is provided so that it enables to rotationally move in a space of the stator 23 together with the rotary shaft 24. The stator 23 provides a torque to the rotor 22 by an electromagnetic action, and the rotor 22 rotates in the circumferential direction.

The SPM motor 20 uses the sintered rare earth magnet according to the present embodiment as permanent magnet 26. Therefore, with the rotation of the SPM motor 20, it enables to maintain the coercivity HcJ of the sintered rare earth magnet high even if the inside of housing 21 is under a high temperature environment, and also enables to improve the temperature properties and strength of the permanent magnet 26. Therefore, the SPM motor 20 enables to improve the capability of motors such as torque characteristics of motors. With that, it enables stably to maintain high output over the long term, and also enables to improve the motor so that it is excellent in reliability.

EXAMPLES

The followings are the specific explanation of the present invention by providing examples and comparative examples. However, the present invention is not limited to the following examples.

1. Alloys (A to F, a to e, a2), Production of Rare Earth Compound

First, the main alloys (alloy A to alloy F) that mainly form the main phase of the magnet and the sub alloys (alloy a to alloy e, a2) that mainly form the grain boundary phase were casted by a strip casting (SC) method. Further, as sub alloys, the rare earth compounds ($Dy_2O_3$, $DyF_3$, $DyH_2$) were further prepared. The magnet compositions of the main alloys (alloy A to alloy F) and the sub alloys (alloy a to alloy e, alloy a2), and the fine particle diameters D50 of the main alloys (alloy A to alloy F), the sub alloys (alloy a to alloy e, alloy a2) and the rare earth compounds ($Dy_2O_3$, $DyF_3$, $DyH_2$) are shown in Table 1. Further, the TRE (Total Rare-Earth) shown in Table 1 indicates the total amount of the rare earth.

TABLE 1

| | | Component (mass %) | | | | | | | | | | | | | Fine Particle Diameter |
|---|---|---|---|---|---|---|---|---|---|---|---|---|---|---|---|
| | | Nd | Pr | Dy | Tb | Co | Al | Cu | B | Ga | Zr | Dy + Tb | TRE | (Dy + Tb)/TRE | D50(μm) |
| Main Alloys | alloy A | 30.0 | 0.0 | 0.0 | 0.0 | 0.5 | 0.2 | 0.1 | 1.05 | | 0.2 | 0.0 | 30.0 | 0.00 | 4.3 |
| | alloy B | 24.0 | 6.0 | 0.0 | 0.0 | 0.0 | 0.2 | 0.0 | 1.05 | 0.1 | 0.2 | 0.0 | 30.0 | 0.00 | 4.4 |
| | alloy C | 26.5 | 0.0 | 4.0 | 0.0 | 0.0 | 0.2 | 0.0 | 1.10 | | 0.2 | 4.0 | 30.5 | 0.13 | 4.2 |
| | alloy D | 30.0 | 0.0 | 0.0 | 2.0 | 1.0 | 0.0 | 0.0 | 1.05 | | 0.2 | 2.0 | 32.0 | 0.06 | 4.4 |
| | alloy E | 23.5 | 5.5 | 2.5 | 0.0 | 2.0 | 0.0 | 0.1 | 1.00 | 0.1 | 0.1 | 2.5 | 31.5 | 0.08 | 4.2 |
| | alloy F | 26.0 | 0.0 | 5.0 | 0.0 | 0.0 | 0.1 | 0.0 | 1.25 | | 0.1 | 5.0 | 31.0 | 0.16 | 4.4 |

TABLE 1-continued

| | | Component (mass %) | | | | | | | | | | | | | Fine Particle Diameter |
|---|---|---|---|---|---|---|---|---|---|---|---|---|---|---|---|
| | | Nd | Pr | Dy | Tb | Co | Al | Cu | B | Ga | Zr | Dy + Tb | TRE | (Dy + Tb)/TRE | D50(μm) |
| Sub Alloys | alloy a | 10.0 | 0.0 | 30.0 | 0.0 | 0.0 | 0.5 | 1.0 | 0.00 | | 0.0 | 30.0 | 40.0 | 0.75 | 4.5 |
| | alloy b | 0.0 | 0.0 | 36.0 | 0.0 | 10.0 | 0.5 | 1.5 | 0.00 | | 0.0 | 36.0 | 36.0 | 1.00 | 4.6 |
| | alloy c | 0.0 | 0.0 | 0.0 | 36.0 | 10.0 | 0.5 | 1.5 | 0.00 | | 0.0 | 36.0 | 36.0 | 1.00 | 4.5 |
| | alloy d | 10.0 | 0.0 | 30.0 | 0.0 | 5.0 | 0.2 | 1.0 | 0.00 | | 0.0 | 30.0 | 40.0 | 0.75 | 4.4 |
| | alloy e | 10.0 | 0.0 | 30.0 | 0.0 | 2.5 | 0.1 | 0.5 | 0.00 | | 0.0 | 30.0 | 40.0 | 0.75 | 4.5 |
| | alloy a2 | 10.0 | 0.0 | 25.0 | 0.0 | 0.0 | 0.5 | 1.0 | 0.00 | | 0.0 | 25.0 | 35.0 | 0.71 | 1.5 |
| Rare Earth Compunds | $Dy_2O_3$ | — | — | — | — | — | — | — | — | — | — | — | — | — | 0.6 |
| | $DyF_3$ | — | — | — | — | — | — | — | — | — | — | — | — | — | 1.5 |
| | $DyH_2$ | — | — | — | — | — | — | — | — | — | — | — | — | — | 1.0 |

2. Production of Sintered Rare Earth Magnet

Examples 1 to 33, Comparative Examples 1 to 6, 8 to 12

Next, as shown in FIG. 3, the sintered rare earth magnets were produced. After implementing a hydrogen storage treatment on these raw material alloys (alloy A to alloy F, alloy a to alloy e) at room temperature, the main alloys (alloy A to alloy F) and the grain phase based alloys (alloy a to alloy e) were coarsely pulverized by implementing a dehydrogenation treatment at 600° C. for an hour in the Ar atmosphere. After the coarse pulverization was respectively performed by a hydrogen pulverization, about 0.1 wt % of oleic amide was added as pulverizing agent to the coarsely pulverized main alloys (alloy A to alloy F) and the sub alloys (alloy a to alloy e) and then the jet mill pulverization was performed by high pressure $N_2$ gas to produce fine powders having the average particle diameter 4.2 μm to 4.6 μm. Further, the oxygen atmosphere was set as 200 ppm after the hydrogen pulverization until sintering step. Next, fine powders of the obtained main alloys (alloy A to alloy F) and fine powders of the sub alloys (alloy a to alloy e, a2) or fine powders of the rare earth compounds ($Dy_2O_3$, $DyF_3$, $DyH_2$) were mixed in a low-oxygen atmosphere so that the mass ratio became the compounding ratio shown in Table 2 to obtain the mixed powders which was raw material powders of the sintered rare earth magnet. Next, the obtained mixed powders were pressed in a magnetic field under the conditions that the pressure was 118 MPa, and the magnetic alignment field was 1200 kA/m and thereby to obtain the green compacts.

The obtained green compacts were sintered by heating with the average temperature rising rate of 2° C./min or more to 10° C./min or less, from 600° C. to the sintering temperature, and maintaining the sintering temperature Ts at 1000° C. to 1080° C. for four hours in vacuum.

After sintering, the sintered bodies were cooled to 200° C. or less in the Ar atmosphere with the condition that the average cooling rate until less than 600° C. is 3° C./min or more to 20° C./min or less. With this, the sintered rare earth magnets having the above composition were produced.

After that, the aging treatment (heat treatment) was performed in the Ar atmosphere. The aging treatment was performed in two steps. After maintaining the first aging treatment temperature T1 at 750° C. to 900° C. for an hour, cooling was performed to 200° C. or less, and the second aging treatment T2 was performed at 510° C. to 570° C. for an hour. When performing the aging treatment, the average heating rate from 600° C. or more to the first aging treatment temperature T1 and the average cooling rate from the first aging treatment temperature T1 to 600° C. may be the same with the average heating rate and the average cooling rate when sintering as mentioned above.

Further, the oxygen concentration when finely pulverizing in examples 23 to 33 and comparative examples 8 to 12 was 2500 ppm.

Comparative Example 7

Further, in comparative example 7, the sintered rare earth magnet was produced under the same condition with example 1, except for using only alloy E.

By using the main alloys (alloy A to alloy F), the sub alloys (alloy a to alloy f, alloy a2) and the rare earth compounds ($Dy_2O_3$, $DyF_3$, $DyH_2$) shown in Table 1, Nd—Fe—B based sintered magnets having a predetermined magnet composition in the compounding ratio shown in Table 2 were produced. The compounding ratio of the main alloys (alloy A to alloy F), the sub alloys (alloy a to alloy f, alloy a2) and the rare earth compounds ($Dy_2O_3$, $DyF_3$, $DyH_2$), the magnet composition of the produced Nd—Fe—B based sintered rare earth magnet, the amount of gas of 0, C, and N are shown in Table 2.

TABLE 2

| | | Sample | Compounding Ratio | Magnet Composition (mass %) | | | | | | | |
|---|---|---|---|---|---|---|---|---|---|---|---|
| | | | | Nd | Pr | Dy | Tb | Co | Al | Cu | B |
| Example | 1 | 1 | alloy A(95) + alloy a(5) | 28.80 | 0.00 | 1.50 | 0.00 | 0.48 | 0.22 | 0.15 | 1.00 |
| | 2 | 2 | | | | | | | | | |
| | 3 | 3 | | | | | | | | | |
| Comparative Example | 1 | 4 | | | | | | | | | |
| | 2 | 5 | | | | | | | | | |
| Example | 4 | 6 | | | | | | | | | |
| | 5 | 7 | | | | | | | | | |
| | 6 | 8 | | | | | | | | | |
| | 7 | 9 | | | | | | | | | |
| | 8 | 10 | | | | | | | | | |
| | 9 | 11 | | | | | | | | | |

TABLE 2-continued

| | | | | | | | | | | | |
|---|---|---|---|---|---|---|---|---|---|---|---|
| Comparative Example | 3 | 12 | | | | | | | | | |
| Example | 4 | 13 | | | | | | | | | |
| Example | 10 | 14 | | | | | | | | | |
| | 11 | 15 | | | | | | | | | |
| Comparative Example | 5 | 16 | | | | | | | | | |
| Examle | 12 | 17 | alloy B(95) + alloy b(5) | 22.60 | 5.60 | 1.80 | 0.00 | 0.50 | 0.20 | 0.08 | 1.00 |
| | 13 | 18 | | | | | | | | | |
| | 14 | 19 | | | | | | | | | |
| Comparative Example | 6 | 20 | | | | | | | | | |
| Example | 15 | 21 | alloy C(95) + alloy a(5) | 25.50 | 0.00 | 5.30 | 0.00 | 0.00 | 0.22 | 0.05 | 1.05 |
| | 16 | 22 | | | | | | | | | |
| | 17 | 23 | | | | | | | | | |
| | 18 | 24 | alloy A(95) + alloy a2(5) | 28.80 | 0.00 | 1.50 | 0.00 | 0.48 | 0.22 | 0.15 | 1.00 |
| | 19 | 25 | alloy C(90) + alloy d(10) | 24.70 | 0.00 | 6.60 | 0.00 | 0.50 | 0.20 | 0.10 | 0.99 |
| Comparative Example | 7 | 26 | alloy E(100) | 23.30 | 5.40 | 2.50 | 0.00 | 2.00 | 0.00 | 0.10 | 1.00 |
| Example | 20 | 27 | alloy A(97) + $Dy_2O_3$(3) | 29.00 | 0.00 | 2.60 | 0.00 | 0.49 | 0.19 | 0.10 | 1.02 |
| | 21 | 28 | alloy A(97) + $DyF_3$(3) | 29.00 | 0.00 | 2.20 | 0.00 | 0.49 | 0.19 | 0.10 | 1.02 |
| | 22 | 29 | alloy A(97) + $DyH_2$(3) | 29.00 | 0.00 | 3.00 | 0.00 | 0.49 | 0.19 | 0.10 | 1.02 |
| | 23 | 30 | alloy F(80) + alloy e(20) | 22.50 | 0.00 | 9.10 | 0.00 | 0.00 | 0.10 | 0.10 | 1.00 |
| Comparative Example | 8 | 31 | | | | | | | | | |
| Example | 24 | 32 | alloy D(95) + alloy c(5) | 28.40 | 0.00 | 0.00 | 3.70 | 1.40 | 0.03 | 0.08 | 1.00 |
| | 25 | 33 | | | | | | | | | |
| | 26 | 34 | | | | | | | | | |
| Comparative Example | 9 | 35 | | | | | | | | | |
| Example | 27 | 36 | | | | | | | | | |
| Comparative Example | 10 | 37 | | | | | | | | | |
| | 11 | 38 | | | | | | | | | |

| | | Magnet Composition (mass %) | | | | Amount of Gas | | |
|---|---|---|---|---|---|---|---|---|
| | | Ga | Zr | Dy + Tb | TRE | O (ppm) | C (ppm) | N (ppm) |
| Example | 1 | 0.00 | 0.19 | 1.50 | 30.30 | 600~1000 | 800~1200 | 400~700 |
| | 2 | | | | | | | |
| | 3 | | | | | | | |
| Comparative Example | 1 | | | | | | | |
| | 2 | | | | | | | |
| Example | 4 | | | | | | | |
| | 5 | | | | | | | |
| | 6 | | | | | | | |
| | 7 | | | | | | | |
| | 8 | | | | | | | |
| | 9 | | | | | | | |
| Comparative Example | 3 | | | | | | | |
| | 4 | | | | | | | |
| Example | 10 | | | | | | | |
| | 11 | | | | | | | |
| Comparative Example | 5 | | | | | | | |
| Examle | 12 | 0.10 | 0.19 | 1.80 | 30.00 | | | |
| | 13 | | | | | | | |
| | 14 | | | | | | | |
| Comparative Example | 6 | | | | | | | |
| Example | 15 | 0.00 | 0.19 | 5.30 | 30.80 | | | |
| | 16 | | | | | | | |
| | 17 | | | | | | | |
| | 18 | 0.00 | 0.19 | 1.50 | 30.30 | | | 910 |
| | 19 | 0.00 | 0.18 | 6.60 | 31.30 | | | 400~700 |
| Comparative Example | 7 | 0.10 | 0.10 | 2.50 | 31.20 | | | |
| Example | 20 | 0.00 | 0.19 | 2.60 | 31.60 | 4650 | | |
| | 21 | 0.00 | 0.19 | 2.20 | 31.20 | 600~1000 | | |
| | 22 | 0.00 | 0.19 | 3.00 | 32.00 | | | |
| | 23 | 0.00 | 0.08 | 9.10 | 31.60 | 3500~4700 | 900~1200 | 150~300 |
| Comparative Example | 8 | | | | | | | |

TABLE 2-continued

| | | | | | |
|---|---|---|---|---|---|
| Example | 24 | 0.00 | 0.19 | 3.70 | 32.10 |
| | 25 | | | | |
| | 26 | | | | |
| Comparative Example | 9 | | | | |
| Example | 27 | | | | |
| Comparative Example | 10 | | | | |
| | 11 | | | | |

3. Evaluation

A relative density of the produced sintered rare earth magnet, a proportion of the main phase grain (the main phase grain wherein the high concentration region was adjacent to at least a part of the low concentration region and the intermediate concentration region was adjacent to at least a part of the high concentration region) wherein a three-layered structure was formed in part, a proportion of the main phase grain (the main phase grain wherein the high concentration region was adjacent to the overall periphery of the low concentration region and the intermediate concentration region was adjacent to the overall periphery of the high concentration region) wherein a three-layered structure was completely formed, magnetic properties, strength, temperature properties, corrosion resistance and average value of concentration of Dy or Tb in the intermediate concentration region were measured in the following way for evaluation.

(Relative Density)

The relative density of the produced sintered rare earth magnet was evaluated by dividing the measured density of the sintered rare earth magnet by the theoretical density. In the present example, the theoretical density of the sintered rare earth magnet was evaluated as a density of $R_2Fe_{14}B$, $Nd_2Fe_{14}B$ was 7.58 $Mg/m^3$, and $Dy_2Fe_{14}B$ was 8.07 $Mg/m^3$. Further, when using two or more of element R, a straight line approximation was used in accordance with the proportions of each element. Specifically, Nd and Dy are used as element R, and when these molar ratio is expressed as Nd:Dy=x:y, the theoretical density of the sintered rare earth magnet is expressed as $(7.58x+8.07y)/(x+y)$.

(A Proportion of the Main Phase Grain Wherein the Three-Layered Structure is Formed in Part, and a Proportion of the Main Phase Grain Wherein the Three-Layered Structure is Completely Formed)

Samples of the sintered rare earth magnet were prepared to observe 70 or more of main phase grains by EPMA. The concentration of the heavy rare earth elements included in the main phase of the sintered rare earth magnet was confirmed to evaluate the proportion of the main phase grain wherein the three-layered structure was formed in part and also the proportion of the main phase grain where the three-layered structure was completely formed. For the proportion of the main phase grain wherein the three-layered structure was formed in part and the proportion of the main phase grain wherein the three-layered structure was completely formed, they were evaluated by the number of main phase grains wherein the three-layered structure was formed in part or the number of main phase grains wherein the three-layered structure was completely formed, after observing the predetermined number of main phase grains per sample.

(Magnetic Properties)

For the magnetic properties of the produced sintered rare earth magnets, the coercivity HcJ and the residual magnetic flux density Br were evaluated by measuring with use of a BH tracer.

(Strength)

Figure 13:
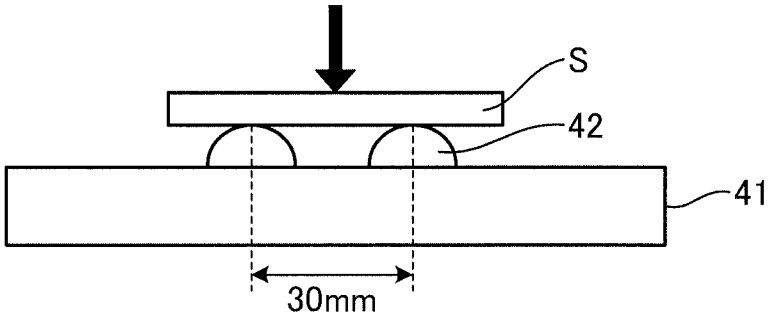
FIG. 13 is an explanation schematically showing an example of three-point bending strength test.

The produced sintered rare earth magnets were machined into test specimen size of 40 mm×10 mm×2 mm to perform a three-point bending strength test. The three-point bending strength test was performed in compliance with JIS R1601 and evaluated by a universal testing machine (AGS-1000A produced by Shimadzu Corporation). FIG. 13 schematically shows an example of the three-point bending strength test. As shown in FIG. 13, a pair of supporting points 42 was arranged on a substrate 41 and a distance between supporting points was determined as 30 mm. The test was performed by arranging a test specimen S on the pair of supporting points 42 and adding loads to the test specimen S.

(Temperature Properties)

The coercivity HcJ at room temperature RT (around 22° C.) and the coercivity HcJ at 140° C., 180° C., 200° C. as predetermined temperature were compared with use of a temperature-variable type magnetic measuring instrument, and the proportion (%) was calculated.

(Corrosion Resistance)

The produced sintered rare earth magnets were machined by an inner circumference slicing machine so that their sizes become 10 mm×10 mm×2 mm respectively, to make washed test specimens as samples. After these samples were put in a constant temperature and humidity chamber in which the temperature was determined as 60° C. and the humidity was determined as 90% RH for 2000 hours, the change of appearance of the test specimen was confirmed and the existence of a rust was evaluated. 100 test specimens (n=100) were prepared and each test specimen was evaluated. Further, in Table 4, a denominator represents the number of test specimens that the existence of rust was observed, and a numerator represents the number of test specimens that rust was found out.

Table 3 shows respective measurement results of the relative density of the sintered rare earth magnets which were produced in respective examples and comparative examples, the proportion of the main phase grain wherein the three-layered structure was formed in part, and the proportion of the main phase grain wherein the three-layered structure was completely formed. Further, in Table 3, the denominator of each number of the proportion of the main phase grain wherein the three-layered structure was formed in part and the proportion of the main phase grain wherein the three-layered structure was completely formed indicates the number of samples in which main phase grains were observed. Further, the numerator indicates the number of the main phase grains wherein the three-layered structure was formed in part and also the number of the main phase grains wherein the three-layered structure was completely formed. Furthermore, Table. 4 shows the measurement result of magnetic properties, strength, temperature properties and corrosion resistance of the sintered rare earth magnets extracted from respective examples and comparative examples shown in Table 3 at every compounding ratio.

(Average Value of Concentration of Dy or Tb in the Intermediate Concentration Region)

Further, when the line analysis was performed on the main phase of the sintered rare earth magnet shown in Table 4 by EPMA, the minimum concentration of Dy or Tb in the low concentration region of the main phase grain was represented as α, and the maximum concentration of Dy or Tb of the high concentration region was represented as β, and the average value of concentration of Dy or Tb in the intermediate concentration region and the average value of concentration of heavy rare earth elements from the maximum concentration of Dy or Tb toward the grain boundary phase were represented as γ, and thereby the value of the following formula (A) was calculated. Further, by the following formula (A) of each main phase grain, the average value of concentration of Dy or Tb in the intermediate concentration region of the main phase grain of each sintered rare earth magnet was calculated. FIGS. 14 to 19 show a relation between the average value of concentration of Dy or Tb in the intermediate concentration region of the man phase of the sintered rare earth magnet, and temperature properties, strength and corrosion resistance of the sintered rare earth magnets shown in Tables 3 and 4.

$$(\gamma-\alpha)/(\beta-\alpha) \qquad \text{formula (A)}$$

TABLE 3

| | Sample | | Compounding Ratio [( ):mass %] | Sintering Temperature (° C.) | Avenge Heating Rate(° C./min) ~600° C. | 600° C.~Ts | Average Cooling Rate(° C./min) Ts~600° C. | less than 600° C. |
|---|---|---|---|---|---|---|---|---|
| Example | 1 | 1 | alloyA(95) + | 1040 | 20 | 4 | 20 | 30 |
| | 2 | 2 | alloy a(5) | | 20 | 7 | 20 | 30 |
| | 3 | 3 | | | 20 | 9 | 20 | 30 |
| Comparative | 1 | 4 | | | 20 | 13 | 20 | 30 |
| Example | 2 | 5 | | | 20 | 20 | 20 | 30 |
| Example | 4 | 6 | | | 10 | 6 | 20 | 30 |
| | 5 | 7 | | | 15 | 6 | 20 | 30 |
| | 6 | 8 | | | 40 | 6 | 20 | 30 |
| | 7 | 9 | | | 50 | 6 | 20 | 30 |
| | 8 | 10 | | | 100 | 6 | 20 | 30 |
| | 9 | 11 | | | 6 | 6 | 15 | 30 |
| Comparative | 3 | 12 | | | 6 | 6 | 30 | 30 |
| Example | 4 | 13 | | | 6 | 6 | 40 | 30 |
| Example | 10 | 14 | | | 6 | 6 | 20 | 10 |
| | 11 | 15 | | | 6 | 6 | 20 | 50 |
| Comparative Example | 5 | 16 | | 1000 | 20 | 6 | 15 | 30 |
| Example | 12 | 17 | alloy B(95) + | 1050 | 10 | 6 | 15 | 30 |
| | 13 | 18 | alloy b(5) | | 10 | 6 | 15 | 40 |
| | 14 | 19 | | | 10 | 6 | 15 | 80 |
| Comparative Example | 6 | 20 | | | 10 | 6 | 40 | 40 |
| Example | 15 | 21 | alloy C(95) + | 1060 | 20 | 4 | 15 | 30 |
| | 16 | 22 | alloy a(5) | | 20 | 4 | 15 | 50 |
| | 17 | 23 | | | 40 | 4 | 15 | 40 |
| | 18 | 24 | alloy A(95) + alloy a2(5) | 1040 | 20 | 4 | 20 | 30 |
| | 19 | 25 | alloy C(90) + alloy d(10) | 1060 | 30 | 4 | 15 | 30 |
| Comparative Example | 7 | 26 | alloy E(100) | 1050 | 30 | 4 | 20 | 30 |
| Example | 20 | 27 | alloy A(97) + $Dy_2O_3$(3) | 1060 | 15 | 6 | 15 | 30 |
| | 21 | 28 | alloy A(97) + $DyF_3$(3) | 1060 | 15 | 6 | 15 | 30 |
| | 22 | 29 | alloy A(97) + $DyH_2$(3) | 1050 | 15 | 6 | 15 | 30 |
| | 23 | 30 | alloy F(80) + | 1080 | 15 | 5 | 15 | 30 |
| Comparative Example | 8 | 31 | alloy e(20) | 1080 | 15 | 5 | 30 | 30 |
| Example | 24 | 32 | alloy D(95) + | 1070 | 10 | 3 | 10 | 25 |
| | 25 | 33 | alloy e(5) | | 10 | 6 | 15 | 30 |
| | 26 | 34 | | | 10 | 9 | 15 | 30 |
| Comparative Example | 9 | 35 | | | 10 | 12 | 15 | 30 |
| Example | 27 | 36 | | | 10 | 3 | 5 | 30 |
| Comparative | 10 | 37 | | | 10 | 3 | 30 | 30 |
| Example | 11 | 38 | | 1020 | 20 | 8 | 15 | 30 |
| Example | 28 | 39 | alloy A(95) + | 1040 | 20 | 3 | 8 | 30 |
| | 29 | 40 | alloy a(5) | 1040 | 20 | 3 | 4 | 30 |
| Comparative Example | 12 | 41 | | 1040 | 20 | 10 | 40 | 40 |
| Example | 30 | 42 | | 1040 | 20 | 6 | 10 | 30 |
| | 31 | 43 | | 1040 | 20 | 3 | 2 | 30 |
| | 32 | 44 | | 1080 | 20 | 2 | 5 | 30 |
| | 33 | 45 | | 1080 | 20 | 4 | 10 | 30 |

TABLE 3-continued

| | | First Aging T1/ Second AgingT2 | Relative Density ($Mg/m^3$) | Proportion(%) of Main Phase Grains wherein a Three-Layered Structure is formed in Part: Measurement Result | Proportion(%) of Main Phase Grains wherein a Three-Layered Structure is formed in Part: (%) | Proportion(%) of Main Phase Grains wherein a Three-Layered Structure is Completely Formed: Measurement Result | Proportion(%) of Main Phase Grains wherein a Three-Layered Structure is Completely Formed: (%) |
|---|---|---|---|---|---|---|---|
| Example | 1 | 800/550 | 99.5 | 12/87 | 13.8 | 3/87 | 3.4 |
| | 2 | | 99.5 | 10/84 | 11.9 | 3/84 | 3.6 |
| | 3 | | 99.5 | 8/90 | 8.9 | 3/90 | 3.3 |
| Comparative | 1 | | 99.5 | 4/82 | 4.9 | 2/82 | 2.4 |
| Example | 2 | | 99.5 | 0/73 | 0.0 | 0/73 | 0 |
| Example | 4 | | 99.5 | 13/90 | 14.4 | 4/90 | 4.4 |
| | 5 | | 99.5 | 10/71 | 12.9 | 3/71 | 4.2 |
| | 6 | | 99.5 | 12/76 | 15.8 | 3/76 | 3.9 |
| | 7 | | 99.5 | 16/94 | 17.0 | 4/94 | 4.3 |
| | 8 | | 99.5 | 11/74 | 14.9 | 3/74 | 4.1 |
| | 9 | | 99.5 | 35/92 | 38.0 | 8/92 | 8.7 |
| Comparative | 3 | | 99.5 | 3/77 | 3.9 | 1/77 | 2.6 |
| Example | 4 | | 99.5 | 4/88 | 4.5 | 1/88 | 2.3 |
| Example | 10 | | 99.5 | 21/84 | 25.0 | 3/84 | 3.8 |
| | 11 | | 99.5 | 25/96 | 26.0 | 3/96 | 3.1 |
| Comparative Example | 5 | | 98.6 | 4/83 | 4.8 | 1/83 | 1.2 |
| Example | 12 | 850/570 | 99.6 | 28/76 | 36.8 | 4/76 | 5.3 |
| | 13 | | 99.4 | 20/84 | 23.8 | 3/84 | 3.6 |
| | 14 | | 99.6 | 22/79 | 27.8 | 3/79 | 3.8 |
| Comparative Example | 6 | | 99.5 | 3/75 | 4.0 | 1/75 | 2.7 |
| Example | 15 | 900/530 | 99.6 | 23/86 | 26.7 | 4/86 | 4.7 |
| | 16 | | 99.6 | 24/89 | 27.0 | 4/89 | 4.5 |
| | 17 | | 99.6 | 19/87 | 21.8 | 4/87 | 4.6 |
| | 18 | 800/550 | 99.3 | 18/80 | 22.5 | 3/80 | 3.8 |
| | 19 | 850/570 | 99.5 | 23/84 | 27.4 | 4/84 | 4.8 |
| Comparative Example | 7 | 800/530 | 99.6 | 0/72 | 0.0 | 0/72 | 0.0 |
| Example | 20 | 900/510 | 99.6 | 24/89 | 27.0 | 4/89 | 4.5 |
| | 21 | 900/510 | 99.1 | 16/93 | 17.2 | 4/93 | 4.3 |
| | 22 | 800/530 | 99.6 | 25/86 | 29.1 | 4/86 | 4.7 |
| | 23 | 750/570 | 99.4 | 22/76 | 28.9 | 3/76 | 3.9 |
| Comparative Example | 8 | | 99.4 | 4/83 | 4.8 | 1/83 | 2.6 |
| Example | 24 | 850/550 | 99.6 | 34/91 | 37.4 | 9/91 | 9.9 |
| | 25 | | 99.5 | 24/87 | 27.6 | 4/87 | 4.6 |
| | 26 | | 99.5 | 25/87 | 28.7 | 4/90 | 4.4 |
| Comparative Example | 9 | | 99.5 | 5/110 | 4.5 | 2/110 | 2.7 |
| Example | 27 | | 99.6 | 37/87 | 42.5 | 10/87 | 11.5 |
| Comparative | 10 | | 99.6 | 4/94 | 4.3 | 1/94 | 2.1 |
| Example | 11 | | 98.5 | 4/88 | 4.5 | 1/88 | 1.1 |
| Example | 28 | 800/550 | 99.5 | 20/96 | 20.8 | 4/96 | 4.2 |
| | 29 | 800/550 | 99.5 | 32/112 | 28.6 | 5/112 | 4.5 |
| Comparative Example | 12 | 800/550 | 99.5 | 4/87 | 4.6 | 1/87 | 1.1 |
| Example | 30 | 800/550 | 99.5 | 15/72 | 20.8 | 3/72 | 4.2 |
| | 31 | 800/550 | 99.5 | 28/108 | 25.9 | 5/108 | 4.6 |
| | 32 | 750/570 | 99.4 | 31/120 | 25.8 | 5/120 | 4.2 |
| | 33 | 750/570 | 99.4 | 26/96 | 27.1 | 4/96 | 4.2 |

TABLE 4

| | | Sample | Compounding Ratio [( ):mass %] | Proportion (%) of Main Phase Grains wherein a Three-Layered Structure is formed in Part | Proportion (%) of Main Phase Grains wherein a Three-Layered Structure is Completely Formed | Magnetic Characteristics [Br(mT)/Hcf(kA/ml) | Strength (MPa) |
|---|---|---|---|---|---|---|---|
| Example | 1 | 1 | alloy A(95) + | 13.8 | 3.4 | 1435/1432 | 262 |
| Comparative | 1 | 4 | alloy a(5) | 4.9 | 2.4 | 1433/1409 | 220 |
| Example | 2 | 5 | | 0.0 | 0.0 | 1434/1412 | 208 |
| Example | 4 | 6 | | 14.4 | 4.4 | 1434/1435 | 253 |
| | 9 | 11 | | 38.0 | 8.7 | 1433/1440 | 267 |
| Comparative | 3 | 12 | | 3.9 | 2.6 | 1433/1417 | 190 |
| Example | 4 | 13 | | 4.5 | 2.3 | 1435/1402 | 195 |
| Comparative Example | 5 | 16 | | 4.8 | 1.2 | 1420/1450 | 190 |

TABLE 4-continued

| | | | | | | | |
|---|---|---|---|---|---|---|---|
| Example | 12 | 17 | alloy B(95) + | 36.8 | 5.3 | 1430/1554 | 255 |
| Comparative Example | 6 | 20 | alloy b(5) | 4.0 | 2.7 | 1430/1522 | 205 |
| Example | 15 | 21 | alloy C(95) + alloy a(5) | 26.7 | 4.7 | 1352/2017 | 248 |
| | 18 | 24 | alloy A(95) + alloy a2(6) | 22.5 | 3.8 | 1430/1563 | 265 |
| | 19 | 25 | alloy C(90) + alloy d(10) | 27.4 | 4.8 | 1325/2120 | 231 |
| Comparative Example | 7 | 26 | alloy E(100) | 0.0 | 0.0 | 1405/1525 | 236 |
| Example | 20 | 27 | alloy A(97) + $Dy_2O_3$(3) | 27.0 | 4.5 | 1384/1583 | 220 |
| | 21 | 28 | alloy A(97) + $DyF_3$(3) | 17.2 | 4.3 | 1392/1554 | 234 |
| | 22 | 29 | alloy A(97) + $DyH_2$(3) | 29.1 | 4.7 | 1371/1682 | 240 |
| | 23 | 30 | alloy F(80) + | 28.9 | 3.9 | 1274/2722 | 236 |
| Comparative Example | 8 | 31 | alloy e(20) | 4.8 | 2.6 | 1275/2687 | 194 |
| Example | 24 | 32 | alloy D(95) + | 37.4 | 9.9 | 1381/2708 | 254 |
| Comparative Example | 9 | 35 | alloy c(5) | 4.5 | 2.7 | 1380/2680 | 220 |
| Comparative | 10 | 37 | | 4.3 | 2.1 | 1382/2667 | 202 |
| Example | 11 | 38 | | 4.5 | 1.1 | 1375/2715 | 198 |
| Example | 28 | 39 | alloy A(95) + | 20.8 | 4.2 | 1434/1435 | 208 |
| | 29 | 40 | alloy a(5) | 28.6 | 4.5 | 1435/1403 | 192 |
| Comparative Example | 12 | 41 | | 4.6 | 1.1 | 1433/1400 | 178 |
| Example | 30 | 42 | | 20.8 | 4.2 | 1435/1429 | 227 |
| | 31 | 43 | | 25.9 | 4.6 | 1434/1426 | 179 |
| | 32 | 44 | alloy F(80) + | 25.8 | 4.2 | 1276/2669 | 190 |
| | 33 | 45 | alloy e(20) | 27.1 | 4.2 | 1276/2706 | 214 |

| | | Temperature Characteristics(%) | Corrosion Resistance [60° C.-90% RH-2000b] (n = 100, the existence of rust was observed) | Average Value of Concentration of Dy or Tb in Intermediate Concentration Region |
|---|---|---|---|---|
| Example | 1 | HcJ(140° C.)/HcJ(RT) = 42.3 | 1/100 | 0.51 |
| Comparative | 1 | HcJ(140° C.)/HcJ(RT) = 40.5 | 4/100 | 0.66 |
| Example | 2 | HcJ(140° C.)/HcJ(RT) = 39.1 | 13/100 | — |
| Example | 4 | HcJ(140° C.)/HcJ(RT) = 41.9 | 1/100 | 0.52 |
| | 9 | HcJ(140° C.)/HcJ(RT) = 42.7 | 0/100 | 0.49 |
| Comparative | 3 | HcJ(140° C.)/HcJ(RT) = 38.4 | 24/100 | 0.69 |
| Example | 4 | HcJ(140° C.)/HcJ(RT) = 38.2 | 26/100 | 0.72 |
| Comparative Example | 5 | HcJ(140° C.)/HcJ(RT) = 40.2 | 16/100 | 0.68 |
| Example | 12 | HcJ(140° C.)/HcJ(RT) = 43.4 | 5/100 | 0.52 |
| Comparative Example | 6 | HcJ(140° C.)/HcJ(RT) = 39.2 | 16/100 | 0.73 |
| Example | 15 | HcJ(180° C.)/Hcc(RT) = 34.5 | 0/100 | 0.59 |
| | 18 | HcJ(140° C.)/HcJ(RT) = 42.3 | 0/100 | 0.53 |
| | 19 | HcJ(180° C.)/HcJ(RT) = 35.9 | 0/100 | 0.60 |
| Comparative Example | 7 | HcJ(140° C.)/HcJ(RT) = 39.8 | 1/100 | — |
| Example | 20 | HcJ(140° C.)/HcJ(RT) = 41.9 | 0/100 | 0.61 |
| | 21 | HcJ(140° C.)/HcJ(RT) = 41.5 | 2/100 | 0.57 |
| | 22 | HcJ(140° C.)/HcJ(RT) = 42.2 | 1/100 | 0.51 |
| | 23 | HcJ(200° C.)/HcJ(RT) = 29.4 | 6/100 | 0.62 |
| Comparative Example | 8 | HcJ(200° C.)/HcJ(RT) = 28.3 | 23/100 | 0.75 |
| Example | 24 | HcJ(200° C.)/HcJ(RT) = 29.6 | 2/100 | 0.45 |
| Comparative Example | 9 | HcJ(200° C.)/HcJ(RT) = 28.6 | 10/100 | 0.69 |
| Comparative | 10 | HcJ(200° C.)/HcJ(RT) = 28.3 | 13/100 | 0.71 |
| Example | 11 | HcJ(200° C.)/HcJ(RT) = 28.0 | 26/100 | 0.79 |
| Example | 28 | HcJ(140° C.)/HcJ(RT) = 42.7 | 1/100 | 0.40 |
| | 29 | HcJ(140° C.)/HcJ(RT) = 42.1 | 1/100 | 0.35 |
| Comparative Example | 12 | HcJ(140° C.)/HcJ(RT) = 38.7 | 34/100 | 0.80 |
| Example | 30 | HcJ(140° C.)/HcJ(RT) = 42.9 | 1/100 | 0.45 |
| | 31 | HcJ(140° C.)/HcJ(RT) = 40.8 | 1/100 | 0.31 |
| | 32 | HcJ(200° C.)/HcJ(RT) = 28.5 | 3/100 | 0.33 |
| | 33 | HcJ(200° C.)/HcJ(RT) = 28.9 | 3/100 | 0.41 |

From Tables 3 and 4, by determining the average heating rate when sintering the green compact, from 600° C. to the sintering temperature Ts, within a predetermined range, it was confirmed that either one of Dy, Tb or both were included so that the three-layered structure was formed in the main phase of the sintered rare earth magnet (refer to examples 1 to 3, 24 to 26, comparative examples 1, 2, and 9). When sintering the green compacts, by determining the average heating rate when sintering the green compacts, from 600° C. to the sintering temperature Ts, within a predetermined range, it enabled to include either one of Dy, Tb or both so that the three-layered structure was formed in the main phase of the sintered rare earth magnet, since the concentration difference of the heavy rare earth elements in the main phase was easily caused.

Further, by determining the average cooling rate when cooling the sintered bodies, from the sintering temperature Ts to 600° C., within a predetermined range, it was confirmed that either one of Dy, Tb or both were included so that the three-layered structure was formed in the main phase of the sintered rare earth magnet (refer to examples 4 to 9, 12 to 23, 27, comparative examples 3, 4, 6, 8, 10). When cooling the sintered bodies, by determining the average cooling rate, from the sintering temperature Ts to 600° C., within a predetermined range, it enabled to include either one of Dy, Tb or both so that the three-layered structure was formed in the main phase of the sintered rare earth magnet, since the concentration difference of the heavy rare earth elements was easily caused.

Further, when the relative density of the sintered rare earth magnet fell below 99%, it was confirmed that either one of Dy, Tb or both were not included so that the three-layered structure was formed in the main phase of the sintered rare earth magnet (refer to comparative example 5 and 11). Therefore, by determining the relative density of the sintered rare earth magnet as 99% or more, it can be said that either one of Dy, Tb or both can be included so that the three-layered structure is formed in the main phase of the sintered rare earth magnet.

Further, when producing the sintered rare earth magnets, if the raw material alloy was one kind, it was not confirmed that either one of Dy, Tb or both were included so that the three-layered structure was formed in the main phase of the sintered rare earth magnet (refer to comparative example 7). Therefore, by producing the sintered rare earth magnets with the use of two kinds of raw material alloys, it can be said that it enables to include either one of Dy, Tb or both so that the three-layered structure is formed in the main phase of the sintered rare earth magnet.

Figure 14:
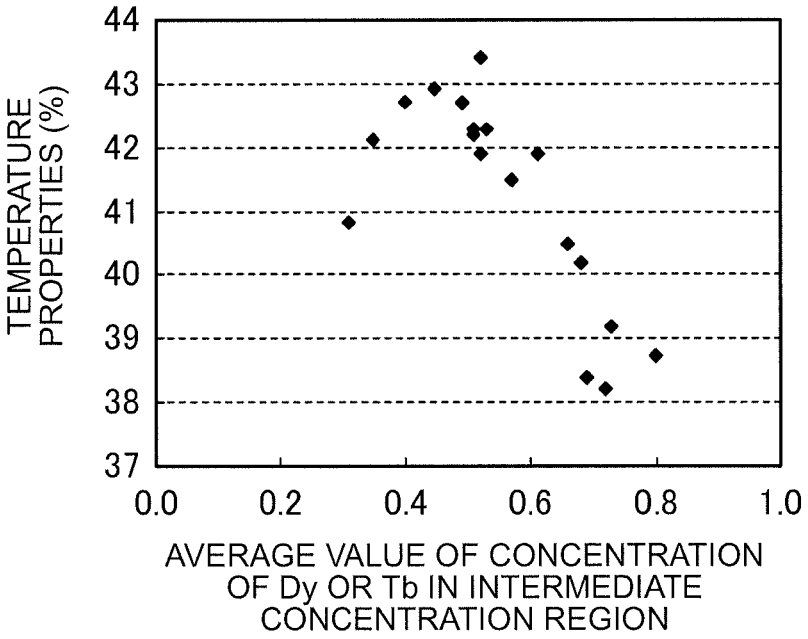
FIG. 14 shows a relation between temperature characteristics (ratio of coercivity at 140° C. and at room temperature) and Dy or Tb concentration of an intermediate concentration region
Figure 15:
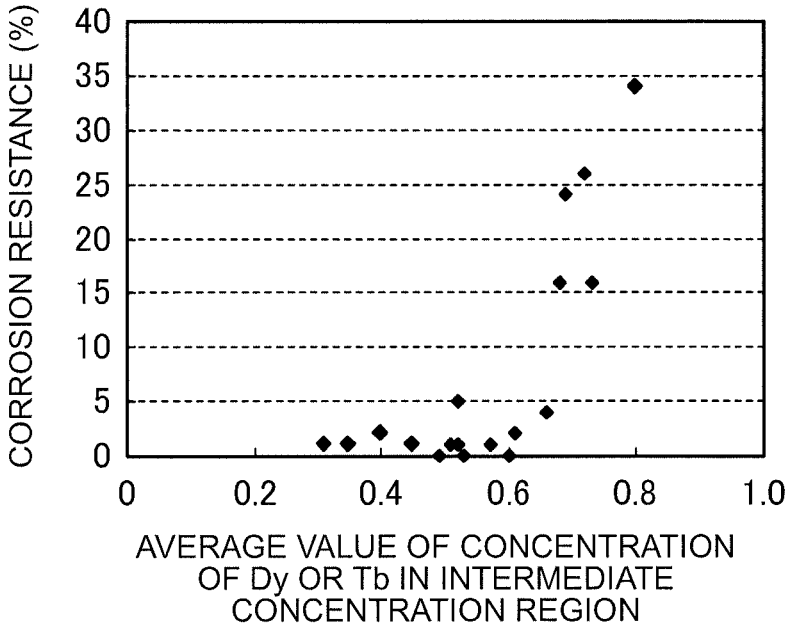
FIG. 15 shows a relation between corrosion resistance and Dy or Tb concentration of an intermediate concentration region, which is the same sample with FIG. 14
Figure 16:
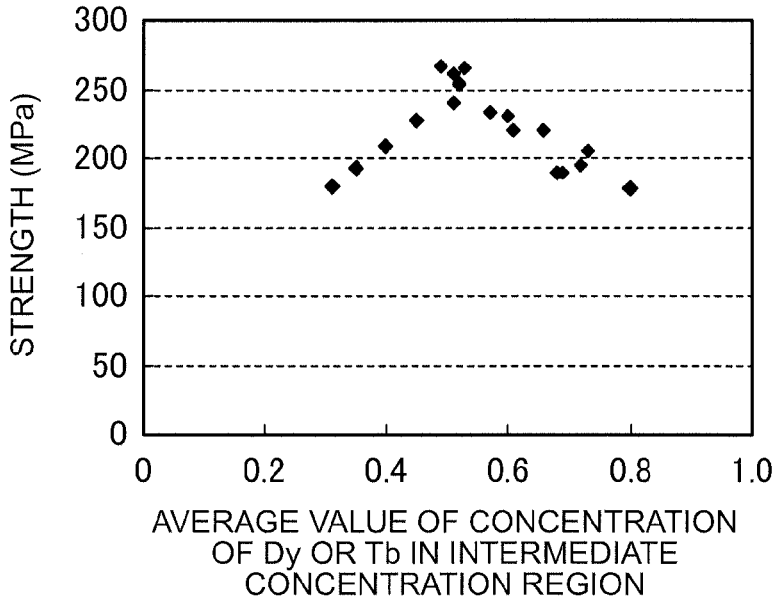
FIG. 16 shows a relation between strength and Dy or Tb concentration of an intermediate concentration region, which is the same sample with FIG. 14.
Figure 17:
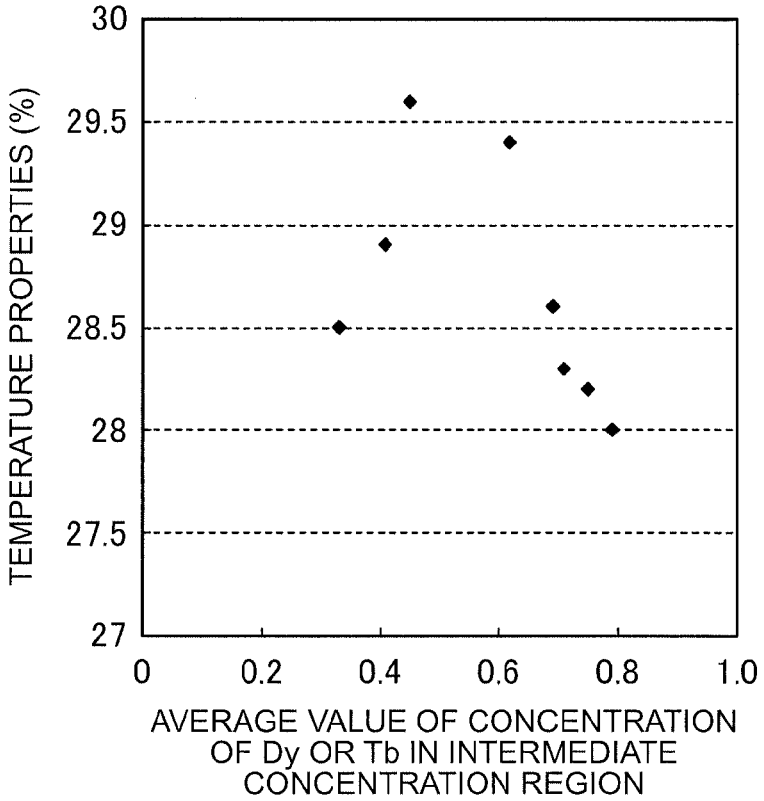
FIG. 17 shows a relation between temperature characteristics (ratio of coercivity at 200° C. and at room temperature) and Dy or Tb concentration of an intermediate concentration region.
Figure 18:
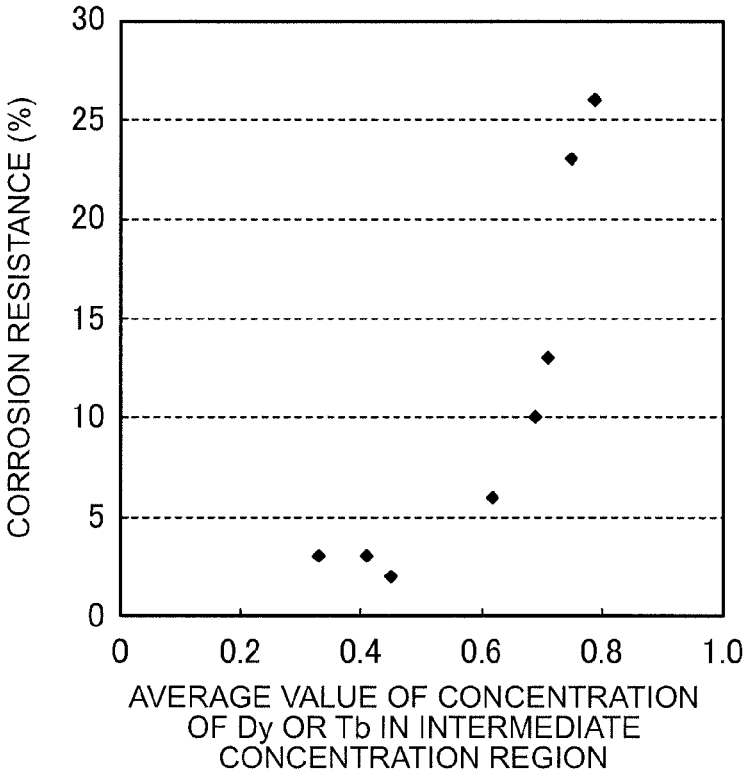
FIG. 18 shows a relation between corrosion resistance and Dy or Tb concentration of an intermediate concentration region, which is the same sample with FIG. 17.
Figure 19:
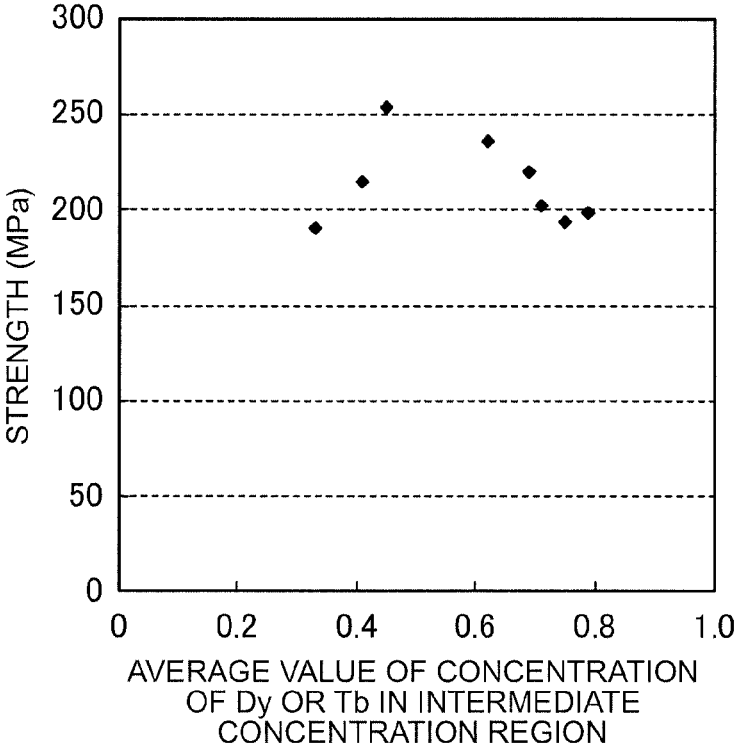
FIG. 19 shows a relation between strength and Dy or Tb concentration of an intermediate concentration region, which is the same sample with FIG. 17.

Further lore, as shown in FIGS. 14 and 17, although temperature properties of the sintered rare earth magnet deteriorated as the concentration of Dy or Tb of the intermediate concentration region increased, the criteria was fully satisfied. Further, as shown in FIGS. 15 and 16, the corrosion resistance of the sintered rare earth magnet was improved as the concentration of Dy or Tb of the intermediate concentration region increased. As shown in FIGS. 16 and 19, although the strength of the sintered rare earth magnet decreased as the concentration of Dy or Tb of the intermediate region increased, the criteria was fully satisfied. Therefore, when the line analysis was performed on the main phase of the sintered rare earth magnet by EPMA, the minimum concentration of Dy or Tb in the low concentration region of the main phase was represented as $\alpha$, and the maximum concentration of Dy or Tb of the high concentration region was represented as $\beta$, and then as long as the average value $\gamma$ of the concentration of Dy or Tb in the intermediate concentration region was within a predetermined range, the three-layered structure was formed in accordance with the concentration of Dy or Tb. With this, the obtained sintered rare earth magnet enabled to maintain the coercivity HcJ high even in a high temperature environment such as at 140° C. to 200° C. Further, as shown in FIG. 10, the average value $\gamma$ of the concentration of Dy or Tb in the intermediate concentration region indicates the average value of the concentration of the heavy rare earth elements in the intermediate concentration region 14. As a result, it enables to improve temperature properties of the obtained sintered rare earth magnet. Further, it can be said that it enables to improve the strength of the obtained sintered rare earth magnet and also enables to improve corrosion resistance.

As above, by determining the average heating rate when sintering green compacts, from 600° C. to the sintering temperature Ts, and the average cooling rate when cooling sintered bodies, from the sintering temperature Ts to 600° C., within a predetermined range to produce sintered rare earth magnets, it enables to include heavy rare earth elements so that the three-layered structure is formed in the main phase of the sintered rare earth magnet. Further, the obtained sintered rare earth magnet includes the heavy rare earth element so that the three-layered structure is formed in the main phase, and thereby temperature properties and strength are further improved. With this, it turns out that it enables to produce the sintered rare earth magnet having improved magnetic properties and corrosion resistance. Therefore, by using the sintered rare earth magnets according to the present embodiment as permanent magnets used for magnetic field sources such as rotating machines like a motor and MRI, it enables to have temperature properties and strength. Therefore, it enables to further improve capabilities of rotating machines and magnetic field sources, and also enables to produce rotating machines and magnetic field sources having high reliability.

DESCRIPTION OF THE REFERENCE NUMERALS

11—main phase
12—low concentration region
13—high concentration region
14—intermediate concentration region
15—grain boundary phase
20—SPM motor
21—housing
22—rotor
23—stator
24—rotary shaft
25—rotor core (iron core)
26—permanent magnet
27—magnet insertion slot
28—stator core
29—throttle
30—coil
41—substrate
42—supporting point
S—test specimen

The invention claimed is:

1. A sintered rare earth magnet, comprising:

a main phase composed of $R_2T_{14}B$, where:

R comprises as a main component one or more rare earth element selected from:

Nd,

Pr, and

Nd and Pr, and

T represents one or more transition metal element selected from:
Fe, and
Fe and Co; and a grain boundary phase containing a higher proportion of R than the main phase;

wherein:

the main phase includes one or more heavy rare earth element selected from:
Dy,
Tb, and
Dy and Tb;

at least a part of main phase grains of the main phase includes at least three regions where the concentration of the heavy rare earth elements differs, the three regions being:
a low concentration region where the concentration of the heavy rare earth elements is the lowest in three regions,
a high concentration region where the concentration of the heavy rare earth elements is the highest in three regions, and
an intermediate concentration region where the concentration of the heavy rare earth elements is higher than the low concentration region and is lower than the high concentration region,
the three regions exist in order of the low concentration region, the high concentration region, and the intermediate concentration region, from the low concentration region in the main phase grain toward the grain boundary phase;

an area ratio of the high concentration region with respect to the main phase is from 1 to 35%;

main phase grains wherein the high concentration region contacts an overall periphery of the low concentration region and the intermediate concentration region contacts an overall periphery of the high concentration region exist at 5% or more in the sintered rare earth magnet, an average concentration value of the heavy rare earth element in the intermediate concentration region is determined as the average concentration value of the heavy rare earth element from the maximum concentration of the heavy rare earth element to the grain boundary phase, and a value of the following formula (A) is in a range of 0.2 to 0.8:

$$(\gamma-\alpha)/(\beta-\alpha) \quad (A)$$

where:
$\alpha$=the minimum concentration of the heavy rare earth element in the main phase,
$\beta$=the maximum concentration of the heavy rare earth element in the main phase, and
$\gamma$=the average concentration value of the heavy rare earth element in the intermediate concentration region.

2. The sintered rare earth magnet according to claim 1, wherein an area ratio of the low concentration region with respect to the main phase is 8 to 40%.

3. The sintered rare earth magnet as set forth in claim 1, wherein an average area ratio of the low concentration region with respect to the main phase is 20% or more.

4. The sintered rare earth magnet as set forth in claim 1, wherein an amount of Co is in the range of 0.3 mass % or more to 4 mass % or less of an amount of Fe.

5. A sintered rare earth magnet, comprising:

a main phase composed of $R_2T_{14}B$, where:
R comprises as a main component one or more rare earth element selected from:
Nd,
Pr, and
Nd and Pr, and
T represents one or more transition metal element selected from:
Fe, and
Fe and Co; and a grain boundary phase containing a higher proportion of R than the main phase;

wherein:

the main phase includes one or more heavy rare earth element selected from:
Dy,
Tb, and
Dy and Tb;

at least a part of main phase grains of the main phase includes at least three regions where the concentration of the heavy rare earth elements differs, the three regions being:
a low concentration region where the concentration of the heavy rare earth elements is the lowest in three regions,
a high concentration region where the concentration of the heavy rare earth elements is the highest in three regions, and
an intermediate concentration region where the concentration of the heavy rare earth elements is higher than the low concentration region and is lower than the high concentration region,
the three regions exist in order of the low concentration region, the high concentration region, and the intermediate concentration region, from the low concentration region in the main phase grain toward the grain boundary phase;

an average area ratio of the high concentration region with respect to the main phase is 5% or more;

main phase grains wherein the high concentration region contacts an overall periphery of the low concentration region and the intermediate concentration region contacts an overall periphery of the high concentration region exist at 5% or more in the sintered rare earth magnet, an average concentration value of the heavy rare earth element in the intermediate concentration region is determined as the average concentration value of the heavy rare earth element from the maximum concentration of the heavy rare earth element to the grain boundary phase, and a value of the following formula (A) is in a range of 0.2 to 0.8:

$$(\gamma-\alpha)/(\beta-\alpha) \quad (A)$$

where:
$\alpha$=the minimum concentration of the heavy rare earth element in the main phase,
$\beta$=the maximum concentration of the heavy rare earth element in the main phase, and
$\gamma$=the average concentration value of the heavy rare earth element in the intermediate concentration region.

6. The sintered rare earth magnet according to claim 5, wherein an area ratio of the low concentration region with respect to the main phase is 8 to 40%.

7. The sintered rare earth magnet as set forth in claim 5, wherein an average area ratio of the low concentration region with respect to the main phase is 20% or more.

8. The sintered rare earth magnet as set forth in claim 5, wherein an amount of Co is in the range of 0.3 mass % or more to 4 mass % or less of an amount of Fe.

* * * * *